US007667086B2

(12) United States Patent
Kowalik et al.

(10) Patent No.: US 7,667,086 B2
(45) **Date of Patent: *Feb. 23, 2010**

(54) OLEFIN OLIGOMERIZATION AND BIODEGRADABLE COMPOSITIONS THEREFROM

(75) Inventors: Ralph M. Kowalik, Kingwood, TX (US); Thomas A. Gribschaw, Friendswood, TX (US); Keith H. Kuechler, Friendswood, TX (US); Ronald R. Hill, Jr., Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 751 days.

This patent is subject to a terminal disclaimer.

(21) Appl. No.: 11/342,365

(22) Filed: Jan. 27, 2006

(65) Prior Publication Data

US 2006/0199988 A1 Sep. 7, 2006

Related U.S. Application Data

(60) Provisional application No. 60/648,947, filed on Jan. 31, 2005, provisional application No. 60/648,938, filed on Jan. 31, 2005, provisional application No. 60/761,973, filed on Jan. 25, 2006.

(51) Int. Cl.
*C07C 2/02* (2006.01)
*C07C 7/20* (2006.01)
*C10L 1/06* (2006.01)

(52) U.S. Cl. ..... 585/533; 585/1; 585/14; 585/517; 585/520; 585/716; 585/722; 502/42; 502/44

(58) Field of Classification Search ..... 585/1, 585/14, 517, 520, 533, 716, 722; 502/42, 502/44

See application file for complete search history.

(56) References Cited

U.S. PATENT DOCUMENTS

| | | | |
|---|---|---|---|
| 3,926,782 | A | 12/1975 | Plank et al. |
| 4,444,988 | A | 4/1984 | Capsuto et al. |
| 4,456,781 | A | 6/1984 | Marsh et al. |
| 4,504,693 | A | 3/1985 | Tabak et al. |
| 4,544,792 | A | 10/1985 | Smith et al. |

(Continued)

FOREIGN PATENT DOCUMENTS

| | | |
|---|---|---|
| EP | 0 916 716 | 5/1999 |

(Continued)

OTHER PUBLICATIONS

N. Amin, et al., "Dealuminated ZSM-5 Zeolite Catalyst for Ethylene Oligomerization to Liquid Fuels", Journal of Natural Gas Chemistry, vol. 11, pp. 79-86, 2002. ( Abstract ).

(Continued)

*Primary Examiner*—In Suk Bullock
*Assistant Examiner*—Prem C. Singh
(74) *Attorney, Agent, or Firm*—Kevin M. Faulkner; David M. Weisburg; Frank E. Reid

(57) ABSTRACT

A hydrocarbon fluid composition that comprises species of at least two different carbon numbers, an aerobic biodegradability of greater than 40% at 28 days, a cetane number of less than 60, and a certain boiling point range; and a process for making the hydrocarbon fluid composition.

11 Claims, 3 Drawing Sheets

U.S. PATENT DOCUMENTS

| | | | |
|---|---|---|---|
| 4,547,612 | A | 10/1985 | Tabak |
| 4,720,600 | A | 1/1988 | Beech, Jr. et al. |
| 4,740,645 | A | 4/1988 | Garwood et al. |
| 4,777,316 | A | 10/1988 | Harandi et al. |
| 4,788,366 | A | 11/1988 | Harandi et al. |
| 4,822,477 | A | 4/1989 | Avidan et al. |
| 4,831,203 | A | 5/1989 | Owen et al. |
| 4,831,204 | A | 5/1989 | Kushnerick et al. |
| 4,834,949 | A | 5/1989 | Owen et al. |
| 4,851,602 | A | 7/1989 | Harandi et al. |
| 4,855,524 | A | 8/1989 | Harandi et al. |
| 4,859,308 | A | 8/1989 | Harandi et al. |
| 4,868,146 | A | 9/1989 | Chu et al. |
| 4,873,385 | A | 10/1989 | Avidan et al. |
| 4,873,389 | A | 10/1989 | Avidan et al. |
| 4,877,921 | A | 10/1989 | Harandi et al. |
| 4,879,428 | A | 11/1989 | Harandi et al. |
| 4,899,014 | A | 2/1990 | Avidan et al. |
| 4,919,896 | A | 4/1990 | Harandi et al. |
| 4,935,568 | A | 6/1990 | Harandi et al. |
| 4,939,314 | A | 7/1990 | Harandi et al. |
| 4,942,021 | A | 7/1990 | Garwood et al. |
| 4,966,680 | A | 10/1990 | Avidan et al. |
| 5,019,357 | A | 5/1991 | Harandi et al. |
| 5,034,565 | A | 7/1991 | Harandi et al. |
| 5,043,499 | A | 8/1991 | Harandi et al. |
| 5,057,640 | A | 10/1991 | Chang et al. |
| 5,063,187 | A | 11/1991 | Burgfels et al. |
| 5,146,032 | A | 9/1992 | Harandi |
| 5,177,279 | A | 1/1993 | Harandi |
| 5,210,347 | A | 5/1993 | Chen et al. |
| 5,234,875 | A | 8/1993 | Han et al. |
| 6,723,889 | B2 | 4/2004 | Miller et al. |
| 2001/0001803 | A1 | 5/2001 | Hubbard et al. |
| 2002/0020107 | A1 | 2/2002 | Bailey et al. |
| 2003/0085153 | A1 | 5/2003 | O'Rear |
| 2003/0116469 | A1 | 6/2003 | Hemighaus et al. |
| 2003/0171632 | A1 * | 9/2003 | Du Toit ..... 585/533 |
| 2004/0034261 | A1 | 2/2004 | O'Reilly et al. |
| 2004/0068923 | A1 | 4/2004 | O'Rear et al. |
| 2004/0148850 | A1 | 8/2004 | O'Rear et al. |
| 2004/0149626 | A1 | 8/2004 | O'Rear et al. |
| 2004/0152792 | A1 | 8/2004 | O'Rear et al. |
| 2004/0152930 | A1 | 8/2004 | O'Rear et al. |
| 2004/0173502 | A1 | 9/2004 | DeHaan et al. |

FOREIGN PATENT DOCUMENTS

| | | |
|---|---|---|
| EP | 1 013 744 | 6/2000 |
| EP | 1 249 486 | 10/2002 |
| EP | 1 359 207 | 11/2003 |
| WO | 89/08090 | 9/1989 |
| WO | WO 00/20534 | 4/2000 |
| WO | WO 00/20535 | 4/2000 |
| WO | WO 01/19762 | 3/2001 |
| WO | WO 01/49812 | 7/2001 |
| WO | WO 01/62875 | 8/2001 |
| WO | WO 02/04575 | 1/2002 |
| WO | 02/092731 | 11/2002 |
| WO | WO 03/104361 | 12/2003 |
| WO | WO 2004/033512 | 4/2004 |

OTHER PUBLICATIONS

S. Schwarz et al., "Effect of Silicon-to-Aluminium Ratio and Synthesis Time on High-Pressure Olefin Oligomerization over ZSM-5", Applied Catalysis, vol. 56, pp. 263-280, Dec. 15, 1989.

S. Inagaki, et al., "Influence of nano-particle agglomeration on the catalytic properties of MFI zeolite", Studies in Surface Science and Catalysis, vol. 135, pp. 566-572, 2001.

P. Yarlagadda, et al, "Oligomerization of Ethene and Propene over Composite Zeolite Catalysts", Applied Catalysis, vol. 62, pp. 125-139, Jun. 20, 1990.

M. Yamamura et al., "Synthesis of ZSM-5 zeolite with small crystal size and its catalytic performance for ethylene oligomerization", Zeolites, vol. 14, pp. 643-649, Nov.-Dec. 1994.

* cited by examiner

OLEFIN OLIGOMERIZATION AND BIODEGRADABLE COMPOSITIONS THEREFROM

CROSS REFERENCE TO RELATED APPLICATIONS

This application claims the benefit of U.S. Provisional Application 60/648,947, filed Jan. 31, 2005; U.S. Provisional Application No. 60/648,938, filed Jan. 31, 2005; and U.S. Provisional Application No. 60/761,973, filed Jan. 25, 2006, all of which are fully incorporated herein by reference. The present application is related by subject matter to co-pending U.S. patent application Ser. No. 11/342,374, filed Jan. 27, 2006; U.S. patent application Ser. No. 11/342,385, filed Jan. 27, 2006; U.S. patent application Ser. No. 11/342,000, filed Jan. 27, 2006; and U.S. patent application Ser. No. 11/342,386, filed Jan. 27, 2006.

FIELD OF THE INVENTION

This invention relates to compositions useful as fuels; such as jet fuel and diesel fuel, and hydrocarbon fluids, such as may be used in consumer products, agricultural chemicals, coatings, printing inks, drilling mud oils, or water treating chemicals, and an olefin oligomerization process for producing such compositions.

BACKGROUND OF THE INVENTION

Improved hydrocarbon compositions are needed to help meet the growing demand for middle distillate products, such as aviation turbine fuels, for example, JP-8 and diesel fuel. Diesel fuel generally provides a higher energy efficiency in compression ignition engines than automotive gasoline provides in spark combustion engines, and has a higher rate of demand growth than automotive gasoline, especially outside the U.S. Further, improved fuel compositions are needed to meet the stringent quality specifications for aviation fuel and the ever tightening quality specifications for diesel fuel as established by industry requirements and governmental regulations.

One known route for producing hydrocarbon compositions useful as fuels is the oligomerization of olefins over various molecular sieve catalysts. Exemplary patents relating to olefin oligomerization include U.S. Pat. Nos. 4,444,988; 4,456,781; 4,504,693; 4,547,612 and 4,879,428. In these disclosures, feedstock olefins are mixed with an olefinic recycle material and contacted with a zeolite, particularly in a series of fixed bed reactors. The oligomerized reaction product is then separated to provide a distillate stream, and typically a gasoline stream, and any number of olefinic recycle streams.

However, in these known oligomerization processes, the focus is on producing relatively heavy distillate products, and even lube base stocks. To enable the production of relatively heavy materials, the processes employ, either directly or indirectly, a relatively large amount of olefinic recycle containing significant quantities of $C_{10}$+ material. The relatively large recycle rate provides control over the exotherm of the oligomerization reaction in the preferred fixed bed, adiabatic reactor system, while the relatively heavy recycle composition enables the growth of heavier oligomers and thus higher molecular weight and denser distillate product. A high rate of recycle requires much larger equipment to handle the increased volumetric flow rate, and uses more separation/fractionation energy, and hence more and larger associated energy conservation elements. Further, a high molecular weight oligomer product requires very high temperatures for the fractionation tower bottoms streams that may eliminate the use of simple steam reboilers and require more expensive and complicated fired heaters.

The recycle streams in conventional olefin oligomerization processes are produced in a variety of fashions typically including some sort of single stage flash drum providing a very crude separation of reactor product as a means of providing some of the relatively heavy components, followed by various fractionation schemes which may or may not provide sharper separations, and again often provide heavy components as recycle. The dense distillate product is generally characterized by a relatively high specific gravity (in excess of 0.775) and a high viscosity, in part due to the composition comprising relatively high levels of aromatics and naphthenes.

Very few references discuss both the merits and methods of producing lighter distillate products, typified by for example jet fuel, kerosene and No. 1 Diesel, via the oligomerization of $C_3$ to $C_8$ olefins. Jet/kero is generally overlooked as a particularly useful middle distillate product, inasmuch as the volume consumed in the marketplace is considerably smaller than its heavier cousins, No. 2 Diesel and No. 4 Diesel (fuel oil). However, jet/kero is a high volume commercial product in its own right, and is also typically suitable as a particular light grade of diesel, called No. 1 Diesel, that is especially useful in colder climates given its tendency to remain liquid and sustain volatility at much lower temperatures. In addition, jet/kero type streams are often blended in with other stocks to produce No. 2 Diesel, both to modify the diesel fuel characteristics, and to allow introduction of otherwise less valuable blendstocks into the final higher value product.

U.S. Pat. No. 4,720,600 discloses an oligomerization process for converting lower olefins to distillate hydrocarbons, especially useful as high quality jet or diesel fuels, wherein an olefinic feedstock is reacted over a shape selective acid zeolite, such as ZSM-5, to oligomerize feedstock olefins and further convert recycled hydrocarbons. The reactor effluent is fractionated to recover a light-middle distillate range product stream and to obtain light and heavy hydrocarbon streams for recycle. The middle distillate product has a boiling range of about 165° C. to 290° C. and contains substantially linear $C_9$ to $C_{16}$ mono-olefinic hydrocarbons, whereas the major portion of the $C_6$ to $C_8$ hydrocarbon components are contained in the lower boiling recycle stream, and the major portion (e.g., 50 wt % to more than 90 wt %) of the $C_{16}$+ hydrocarbon components are contained in the heavy recycle fraction.

Isoparaffinic hydrocarbon fluid compositions in various boiling ranges and having a number of other characteristic properties are also of interest, and are subject to the same increasing quality requirements as fuels noted above, particularly in terms of environmental and hygienic performance. A typical isoparaffinic fluid manufacturing method includes oligomerization of propylene or butene feeds to form higher olefins, followed by hydrogenation, and, optionally fractionation before or after hydrogenation. The chemical properties (f. ex. carbon number, branching level, biodegradability) and physical properties and volumes of isoparaffinic fluids obtained by this method are determined by types of feedstocks available for oligomerization. Hence it is desirable to find other manufacturing methods that allow to increase production volumes and can lead to different types of isoparaffinic hydrocarbons.

The present invention provides a novel process well suited to the production of new isoparaffinic hydrocarbon fluid compositions. While this process is primarily aimed at the production of high quality jet fuel, the process has many advantageous attributes relative to the historical processes from which hydrocarbon fluids were derived. For example, in making a wide boiling range fuel, vis-à-vis the solid phosphoric acid process for light carbon number motor gasoline production, or the butene dimerization process over zeolites for eventual oxo-alcohol production, which are focused on a narrow product series, the process of the present invention has a greater flexibility to handle a wide array of olefin feedstocks, and greater flexibility to vary the product carbon number distribution through control of the olefinic recycle rate and composition. Further, the process of the present invention can make a unique isoparaffinic hydrocarbon fluid composition having a very low content of naphthenes and aromatics, particularly in combination with relatively high boiling points, which has been a significant challenge to the industry.

Amid ever increasing SHE (safety/health/environmental) concerns, hydrocarbon fluids are continuously challenged to provide better SHE performance while still fulfilling necessary application requirements. The principal SHE objectives are lower photochemical reactivity to reduce air pollution, increased biodegradability to reduce water pollution, and lower levels of aromatic species to reduce adverse health effects to humans and to aquatic organisms. Key application requirements are acceptable solvency and an ability to be used at high, low, and ambient temperatures.

Synthetic isoparaffin fluids made from light gases such as propylenes, butenes, isobutene, and/or pentylenes have been made with very low levels of aromatics and relatively low photochemical reactivities. Their branched structures have also provided acceptable solvency for many applications with acceptable performance over wide temperature ranges; however, their highly branched structures, which frequently contain quaternary carbons, have been responsible for inferior biodegradability. For less volatile grades with higher molecular weights, naphthenic or cycloparaffin structures that adversely affect photochemical reactivity also become more concentrated.

Normal paraffin fluids separated from petroleum streams or produced by Fischer-Tropsch reactions have also been made with very low levels of aromatics, very low photochemical reactivities, and acceptable solvency for many applications. Their high concentrations of linear structures across all molecular weight ranges provide superior biodegradability; however, the linear molecules also compromise performance at lower temperatures by forming wax crystals in the fluid. The latter can be especially important in the transportation, storage, and use of normal paraffins in colder environments.

The present invention discloses a novel composition of isoparaffin molecules that can be made commercially with very low photochemical reactivity, very low aromatic contents, good biodegradability, and acceptable application performance across wide temperature ranges. They could be used in consumer products, agricultural chemicals, coatings, printing inks, drilling mud oils, water treating chemicals, and other hydrocarbon fluid applications.

SUMMARY OF THE INVENTION

One embodiment of the present invention is a hydrocarbon fluid composition comprising non-normal hydrocarbons of at least two different carbon numbers; a minimum initial boiling point to maximum final boiling point at or within a range of 110° C. to 350° C.; an aerobic biodegradability of greater than 40% at 28 days; and a cetane number of less than 60.

Another embodiment of the present invention is a hydrocarbon fluid composition comprising non-normal hydrocarbons of at least two different carbon numbers; an initial boiling point in the range of from about 110° C. to about 275° C. and a final boiling point in the range of from about 140° C. to about 350° C.; an aerobic biodegradability of greater than 40% at 28 days; and a cetane number of less than 60.

In further embodiments, in addition to the limitations of any one of the above embodiments, the aerobic biodegradability of the hydrocarbon fluid composition is greater than 45% at 35 days.

In further embodiments, in addition to the limitations of any one of the above embodiments, the hydrocarbon fluid composition has a fluid pour point of less than −30° C.

In further embodiments, in addition to the limitations of any one of the above embodiments, the hydrocarbon fluid composition has a freezing point of less than −35° C.

In further embodiments, in addition to the limitations of any one of the above embodiments, the hydrocarbon fluid composition has a cloud point of less than −30° C.

In further embodiments, in addition to the limitations of any one of the above embodiments, the hydrocarbon fluid composition has a cetane index of less than 65.

In further embodiments, in addition to the limitations of any one of the above embodiments, the hydrocarbon fluid composition has a branching index of at least 1.5.

In further embodiments, in addition to the limitations of any one of the above embodiments, the hydrocarbon fluid composition comprises less than 10 wt % naphthenes.

In further embodiments, in addition to the limitations of any one of the above embodiments, the hydrocarbon fluid composition comprises no greater than 1000 wppm aromatics.

Another aspect of the present invention is a process to produce the above hydrocarbon fluid composition of the present invention, as well as middle distillate fuel products and higher molecular weight hydrocarbons. The process comprises: (a) contacting a feed comprising at least one $C_3$ to $C_8$ olefin and an olefinic recycle stream with a molecular sieve catalyst in at least one reaction zone under olefin oligomerization conditions such that the recycle to feed weight ratio is from 0.1 to 3.0, the WHSV is at least 0.5 based on the olefin in the feed, and the difference between the highest and lowest temperatures within said at least one reaction zone is 40° F. (22° C.) or less, said contacting producing a oligomerization effluent stream; (b) separating said oligomerization effluent stream into at least a hydrocarbon product stream having a first difference in initial boiling point and final boiling point temperatures, and said olefinic recycle stream, wherein the olefinic recycle stream contains no more than 10 wt % of $C_{10}$+ non-normal olefins, and the hydrocarbon product stream contains at least 1 wt % and no more than 30 wt % of $C_9$ non-normal olefins; and (c) separating the hydrocarbon product stream into said hydrocarbon fluid composition and at least one remainder separated stream, wherein said hydrocarbon fluid composition has: (i) a second difference in initial boiling point and final boiling point temperatures, wherein said second difference is less than said first difference; and (ii) an aerobic biodegradability of at least 40% at 28 days.

Another embodiment of the present invention is a process comprising: (a) contacting a feed comprising at least one $C_3$ to $C_8$ olefin and an olefinic recycle stream with a molecular sieve catalyst in at least one reaction zone under olefin oligomerization conditions such that the recycle to feed weight ratio is from 0.1 to 3.0, the WHSV is at least 0.5 based on the olefin in the feed, and the difference between the highest and lowest temperatures within said at least one reaction zone is 40° F. (22° C.) or less, said contacting producing a oligomerization effluent stream; (b) separating said oligomerization effluent stream into at least a hydrocarbon product stream having a first difference in initial boiling point and final boiling point temperatures, and said olefinic recycle stream, wherein the olefinic recycle stream contains no more than 10 wt % of $C_{10}$+ non-normal olefins, and the hydrocarbon product stream contains at least 1 wt % and no more than 30 wt % of $C_9$ non-normal olefins; (c) producing a hydrocarbon fluid composition from said hydrocarbon product stream by the steps of: (i) separating said hydrocarbon product stream to form at least a first separated hydrocarbon product stream and a remainder separated hydrocarbon product stream, and hydrogenating said first separated hydrocarbon product stream to form said hydrocarbon fluid composition; or (ii) hydrogenating said hydrocarbon product stream to form a hydrogenated hydrocarbon product stream, and separating said hydrogenated hydrocarbon product stream to form said hydrocarbon fluid composition, wherein said hydrocarbon fluid composition has a second difference in initial boiling point and dry point temperatures, wherein said second difference is less than said first difference; and an aerobic biodegradability of at least 40% at 28 days In further embodiments, in addition to the limitations of any one of the above embodiments, the feed comprises a mixture of $C_3$ to $C_5$ olefins comprising at least 5 wt % of $C_4$ olefin.

In further embodiments, in addition to the limitations of any one of the above embodiments, the feed contains $C_4$ olefin and the contacting (a) is conducted so as to convert from 85 wt % to 96 wt % of the $C_4$ olefin in the feed.

In further embodiments, in addition to the limitations of any one of the above embodiments, the highest and lowest temperatures within said at least one reaction zone are between 150° C. and 350° C.

In further embodiments, in addition to the limitations of any one of the above embodiments, the hydrocarbon product stream comprises from 0.5 wt % to 20.0 wt % of $C_{17}$ to $C_{20}$ hydrocarbons.

In further embodiments, in addition to the limitations of any one of the above embodiments, the hydrocarbon product stream comprises at least 90 wt % $C_9$ to $C_{20}$ non-normal olefins.

In further embodiments, in addition to the limitations of any one of the above embodiments, the hydrocarbon fluid composition comprises non-normal hydrocarbons of at least two different carbon numbers.

In further embodiments, in addition to the limitations of any one of the above embodiments, the hydrocarbon fluid composition has a Bromine Index of no greater than 1000 mg Br/100 g sample.

In further embodiments, in addition to the limitations of any one of the above embodiments, the hydrocarbon fluid composition comprises at least 95 wt % non-normal paraffins.

In further embodiments, in addition to the limitations of any one of the above embodiments, the hydrocarbon fluid composition comprises less than 10 wt % naphthenes.

Any two or more of the above embodiments can be combined to describe additional embodiments of the invention of this patent application.

DETAILED DESCRIPTION OF THE EMBODIMENTS

Terms and Measurements

Figure 1:
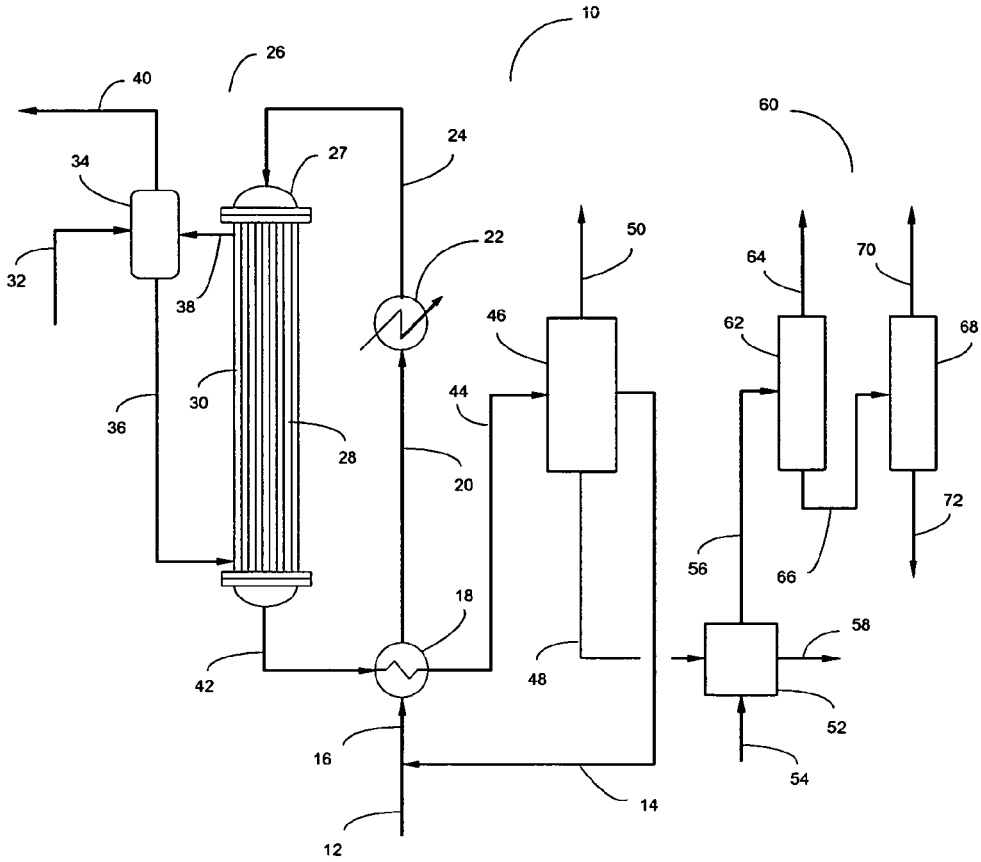
FIG. 1 is a flow diagram of a process for producing a hydrocarbon composition according to one embodiment of the invention.

As used herein, the term "$C_x$ hydrocarbon" indicates hydrocarbon molecules having the number of carbon atoms represented by the subscript "x". The term "$C_x$+ hydrocarbons" indicates those molecules noted above having the number of carbon atoms represented by the subscript "x" or greater. For example, "$C_{10}$+ hydrocarbons" would include $C_{10}$, $C_{11}$, and higher carbon number hydrocarbons. Similarly "$C_x$– hydrocarbons" indicates those molecules noted above having the number of carbon atoms represented by the subscript "x" or fewer.

Unless otherwise specifically noted, Weight Hourly Space Velocity (WHSV) values cited herein are based on the amount of the molecular sieve contained in the olefin oligomerization catalysts without allowing for any binder or matrix that may also be present in the catalyst.

The initial boiling point and final boiling point of the hydrocarbon fluid composition is determined by ASTM D86-05, the entire contents of which are incorporated herein by reference. The final boiling point according to this method is also known as the dry point. Herein, the listing of a "minimum initial boiling point to maximum final boiling point range at or within" a prescribed pair of temperature figures means that the initial boiling point will have a value no less than the first figure listed in the pair, and the final boiling point will have a value no greater than the second number listed in the pair. Further, the final boiling point will always be a greater temperature than the initial boiling point. Thus, for example, the hydrocarbon fluid composition could have an initial boiling point of 190° C. and a final boiling point of 340° C., or initial boiling point of 310° C. and a final boiling point of 350° C.; either would fulfill a stipulation of a minimum initial boiling point to maximum final boiling point range at or within 185 to 350° C.

The term "difference in initial boiling point and final boiling point" used herein is the numerical difference of the initial boiling point subtracted from the final boiling point, i.e., the absolute value of the difference between the figures in the boiling point range of a given material (e.g., a boiling point range 170 to 350° C. would have a difference in initial boiling point and final boiling point of 180° C.).

The determination of the identity and content of hydrocarbon species can be accomplished by a number of suitable methods well known to those skilled in the art, such as combined gas chromatograph/mass spectroscopy (GC/MS), Nuclear Magnetic Resonance (NMR) and Infrared Spectroscopy (IR) techniques, potentially in combination. A straightforward method that can be used for a determination of the hydrocarbon fluid properties noted herein is the normal paraffin (or linear paraffin) gas chromatograph method. That is, for an appropriate gas chromatograph with a separation column of adequate resolution, a normal paraffin of a given carbon number is assumed to delineate a peak, above which, species may be assumed to comprise the carbon number of the next higher carbon number normal paraffin peak. For example, all peaks for material eluting in between the peaks for n-decane and n-undecane are assumed to be $C_{11}$ species. Similarly for this method, the quantity of non-normal hydrocarbons is determined as the total peak area of the chromatogram less the sum of the normal paraffins. NMR and IR techniques on narrow boiling range aliquots derived from a broader boiling range sample are also usefull to determine non-normal hydrocarbon concentration and type. Any method of reasonable resolution will provide similar results to distinguish a hydrocarbon fluid of the present invention, although perhaps at slightly different absolute values depending on its sophistication and calibration standards.

The term "carbon number" as used herein refers to the number of carbon atoms in a species. For example, a composition having a species with 3 different carbon numbers may mean a complex mixture of $C_5$ species, $C_9$ species, and $C_{12}$ species.

The analytical determination of naphthene content has historically been quite difficult due to the relatively close nature of that specie to isoparaffins. Naphthene content may be determined via methods such as GC/MS, such as ASTM Test Method D2475 and ASTM Test Method D2786, the MS being necessary to differentiate the naphthenes from the olefins and saturates via their atomic fracture patterns, or NMR or IR spectroscopy measurements. Preferably, the content of naphthenes may also be determined (or validated) via knowledge of the properties of various specific components, there typically being a very limited number of different species in such compositions. Each species (e.g., normal paraffins, iso-paraffins and naphthenes) have distinct density and refractive index properties that may be correlated to determine the blend quantities. It may be desirable to understand other properties of the composition first by other methods, for example, the amount of aromatics and isoparaffins, to ensure the reliability of such a technique. Another excellent method to employ in the method of the present invention for the determination of naphthene content is a hybrid GC method such as 2-D GC (some details of which may be found at http://www.srigc.com/2003catalog/cat-21.htm), which provides greater resolution of naphthenic species relative to normal and iso-paraffinic species than conventional GC.

The content of aromatics is to be determined by a suitable ultraviolet spectrophotometric method. Any method of reasonable resolution, well known to those skilled in the art, will provide the same results within about +/−20%, with the difference attributable to the type of aromatics and substrate used for calibration of a given method. One straightforward method that can be used for a determination of the content of aromatics of a hydrocarbon fluid noted herein is France NF M 07-073, "Determination of Total Aromatics Content in Heating Fuels and Other Mainly Saturated Hydrocarbons," the entire contents of which are incorporated herein by reference.

Bromine Index is determined by ASTM Test Method D2710 with units of mg Br/100 g sample, the entire contents of which are incorporated herein by reference.

The term "normal olefin" or "normal paraffin" (both being examples of "normal hydrocarbons") refers to any olefin or paraffin that contains a single, unbranched chain of carbon atoms as defined in *Hawley's Condensed Chemical Dictionary*, 14$^{th}$ Edition. Therefore a "non-normal olefin" or "non-normal paraffin" as used herein, is a hydrocarbon that is not "normal" and would, therefore, contain at least one branched chain of carbon atoms. Naphthenes are cyclo-paraffins or cyclo-olefins that may contain an additional alkyl group or groups, and are considered non-normal hydrocarbons. Similarly, an aromatic is as defined in *Hawley's Condensed Chemical Dictionary*, 14$^{th}$ Edition. In general, an aromatic comprises at least one 6 carbon number ring moiety with three double bonds in the ring, which may have additional alkyl group substituents.

Biodegradability was determined by the Organization of Economic Cooperation and Development (OECD) Method 301 F, Manometric Respirometry Test. Various bodies, such as ISO and the OECD have developed test methods to quantify biodegradability. One type of such tests include oxygen consumption and $CO_2$ evolution methods which test for ready biodegradability. The OECD Method 301 F involves a measured volume of inoculated mineral medium, containing a known concentration of test substance (100 mg test substance per liter giving at least 50-100 mg Theoretical Oxygen Demand [ThOD] per liter) as the nominal sole source of organic carbon. This volume is placed in a closed flask and stirred at constant temperature for up to 28 days or longer. The consumption of oxygen supplied to the material in the flask is determined either by measuring the quantity of oxygen required to maintain constant gas volume in the respirometer flask, and/or from the change in volume or pressure in the apparatus. Evolved carbon dioxide is absorbed in a solution of potassium hydroxide or other suitable absorbant. The amount of oxygen taken up by the microbial population during biodegradation of the test substance (corrected for uptake by blank inoculum, run in parallel) is expressed as a percentage of ThOD. For additional details and acceptable variations refer to the standard test procedure, which can be found at, for example, http://www.oecd.org/dataoecd/17/16/1948209.pdf.

Cetane number was determined by ASTM Test Method D613. Cetane index was determined by ASTM Test Method D976.

Hydrocarbon fluid pour point was determined by ASTM Test Method D97. Hydrocarbon fluid freezing point was determined by ASTM Test Method D2386. Hydrocarbon fluid cloud point was determined by ASTM Test Method D5773.

Branching Index was determined as follows. The total number of carbon atoms per molecule is determined. A preferred method for making this determination is to estimate the total number of carbon atoms from the molecular weight. A preferred method for determining the molecular weight is Vapor Pressure Osmometry following ASTM-2503, provided that the vapor pressure of the sample inside the Osmometer at 45° C. is less than the vapor pressure of toluene. For samples with vapor pressures greater than toluene, the molecular weight is preferably measured by benzene freezing point depression. Commercial instruments to measure molecular weight by freezing point depression are manufactured by Knauer. ASTM D2889 may be used to determine vapor pressure. Alternatively, molecular weight may be determined from ASTM D-2887 or ASTM D-86 distillation by correlations which compare the boiling points of known n-paraffin standards.

Continuing with the determination of Branching Index, the fraction of carbon atoms contributing to each branching type is based on the methyl resonances in the carbon NMR spectrum and uses a determination or estimation of the number of carbons per molecule. The area counts per carbon is determined by dividing the total carbon area by the number of carbons per molecule. Defining the area counts per carbon as "A", the contribution for the individual branching types is as follows, where each of the areas is divided by area A:

2−branches=half the area of methyls at 22.5 ppm/A

3−branches=either the area of 19.1 ppm or the area at 11. 4 ppm (but not both)/A 4−branches=area of double peaks near 14.0 ppm/A 4+branches=area of 19.6 ppm/A minus the 4−branches internal ethyl branches=area of 10.8 ppm/A The total branches per molecule (i.e. the branching index) is the sum of areas above.

Oligomerization Feed

The fresh feed to the oligomerization process can include any single $C_3$ to $C_8$ olefin or any mixture thereof in any proportion. Particularly suitable feeds include mixtures of propylene and butylenes having at least 5 wt %, such as at least 10 wt %, for example, at least 20 wt %, such as at least 30 wt % or at least 40 wt % $C_4$ olefin. Also useful are mixtures of $C_3$ to $C_5$ olefins having at least 40 wt % $C_4$ olefin and at least 10 wt % $C_5$ olefin, or at least 30 wt % $C_4$ olefin and at least 20 wt % $C_5$ olefin, or at least 40 wt % $C_4$ olefin and at least 10 wt % $C_5$+ olefin. Also useful are mixtures of $C_3$ to $C_5$ olefins having at least 40 wt % $C_4$ olefin and at least 10 wt % $C_5$ olefin, and having little propylene, say less than 5 wt %, or less than 1 wt %, or less than 0.1 wt % propylene.

Conveniently, the feed should contain no more than about 1.0 wt %, or even no more than 0.1 wt % of $C_2$− hydrocarbons, because ethylene is less reactive in the present process than other light olefin, and thus requires substantially more processing to obtain a good ultimate conversion. Further, ethylene and light saturates, such as ethane and methane, are highly volatile, and it will require much more work to recover them in the separation system, likely necessitating the use of expensive and complicated refrigeration systems. It is also of benefit to limit the amount of $C_9$+ hydrocarbons, of any kind, in the feed, to no more than about 10 wt %, or no more than 5 wt %, or even no more than 1 wt %, because $C_9$+ hydrocarbons are useful components of the hydrocarbon product stream and so it is counter-productive to subject them to the oligomerization process of the invention.

It is also desirable to limit the amount of saturates in the feed stream, because saturates are not converted in the oligomerization step and tend to accumulate in the olefinic recycle stream, thereby reducing the light olefin content of the olefinic recycle stream. The amount of non-olefins, especially saturates, in the feed stream should be less than 45 wt %, such as less than 35 wt %, for example, less than 25 wt %, typically less than 15 wt %, or less than 10 wt % or even less than 5 wt %. More particularly, the amount of non-olefins, especially saturates in the feed stream should be from about 5 wt % to about 45 wt %, from about 10 wt % to about 35 wt %, from about 15 wt % to about 25 wt %. More particularly, the amount of propane can be no greater than about 10 wt %, such as no more than 5 wt %, for example, no more than 1 wt %, or no more than 0.5 wt %. Even more particularly, the amount of propane can be no greater than about 0.5 wt % to about 10 wt % or about 1 wt % to about 5 wt %.

In one embodiment, the olefinic feed is obtained by the conversion of an oxygenate, such as methanol, to olefins over a silicoaluminophosphate (SAPO) catalyst, according to the method of, for example, U.S. Pat. Nos. 4,677,243 and 6,673,978; or an aluminosilicate catalyst, according to the method of, for example, WO04/18089; WO04/16572; EP 0 882 692; and U.S. Pat. No. 4,025,575. Alternatively, the olefinic feed can be obtained by the catalytic cracking of relatively heavy petroleum fractions, or by the pyrolysis of various hydrocarbon streams, ranging from ethane to naphtha to heavy fuel oils, in admixture with steam, in a well understood process known as "steam cracking".

As stated above, the overall feed to the oligomerization process also contains an olefinic recycle stream containing no more than 10 wt % of $C_{10}$+ non-normal olefins. Generally, the olefinic recycle stream should contain no greater than 7.0 wt %, for example, no greater than 5.0 wt %, such as no greater than 2.0 wt %, or no greater than 1.0 wt %, or even no greater than 0.1 wt % of $C_{10}$+ non-normal olefins. The olefinic recycle stream should contain from about 0.1 wt % to about 10.0 wt %, or about 0.5 wt % to about 10.0 wt %, or about 1.0 wt % to about 7.0 wt % of $C_{10}$+ non-normal olefins. Alternatively, the final boiling point temperature of the olefinic recycle stream should be no greater than 360° F. (182° C.), no greater than 340° F. (171° C.), such as no greater than 320° F. (160° C.), for example, no greater than 310° F. (154° C.), or even no greater than 305° F. (152° C.). The final boiling point temperature of the olefinic recycle stream should be in the range of from 300° F. (149° C.) to 360° F. (182° C.), from 305° F. (152° C.) to 340° F. (171° C.), or from 310° F. (154° C.) to 320° F. (160° C.). In one embodiment, the olefinic recycle stream contains no greater than 30.0 wt %, such as, no greater than 25.0 wt %, for example, no greater than 20.0 wt %, or no greater than 15.0 wt %, or no greater than 10.0 wt % of $C_9$+ non-normal olefins. The olefinic recycle stream may contain from about 5.0 wt % to about 30.0 wt %, or from about 10 wt % to about 25 wt %, or from about 15 wt % to about 20 wt % of $C_9$+ non-normal olefins. Alternatively, the final boiling point temperature of the olefinic recycle stream can be no greater than 290° F. (143° C.), such as no greater than 275° F. (135° C.), for example, no greater than 260° F. (127° C.). The final boiling point temperature of the olefinic recycle stream can be in the range of from 260° F. (127° C.) to 310° F. (154° C.) or from 275° F. (135° C.) to 290° F. (143° C.).

In one embodiment, the olefinic recycle stream can contain at least 1 wt %, at least 5 wt %, at least 10 wt %, at least 15 wt %, or at least 20 wt % $C_4$ hydrocarbons of any species. In one embodiment, the olefinic recycle stream contains no greater than 50 wt %, no greater than 40 wt %, no greater than 30 wt %, or no greater than 25 wt %, or no greater than 20 wt %, or no greater than 10 wt %, or no greater than 5 wt % $C_4$ hydrocarbons of any species. The olefinic recycle stream can contain from about 1 wt % to about 50 wt %, or from about 5 wt % to about 40 wt %, or from about 10 wt % to about 30 wt %, or from about 20 wt % to about 25 wt % $C_4$ hydrocarbons of any species. Additionally, the olefinic recycle stream may contain no greater than 20 wt %, no greater than 10 wt %, no greater than 5 wt %, or no greater than 2 wt % $C_3$− hydrocarbons, such as propylene or propane. The olefinic recycle stream may contain from about 0.1 wt % to about 20 wt %, or from about 0.5 wt % to about 10 wt %, or from about 1.0 wt % to about 5 wt %, or from about 1.5 wt % to about 2 wt % $C_3$− hydrocarbons, such as propylene or propane. This can be achieved by, for example, employing an additional separation of all or a portion of the olefinic recycle stream generated by a separation device into one stream comprising $C_4$− with only a small amount of $C_5$+ hydrocarbons, and a second debutanized stream as all or a portion of the olefinic recycle stream provided to the oligomerization reactor.

In one embodiment, the olefinic recycle stream contains no more than about 7.0 wt % of $C_9$+ non-normal olefins, for example, no greater than about 5.0 wt %, such as no greater than about 2.0 wt %, or no greater than about 1.0 wt %, or even no greater than about 0.1 wt % of $C_9$+ non-normal olefins. The olefinic recycle stream should contain from about 0.1 wt % to about 10.0 wt %, or about 0.5 wt % to about 10.0 wt %, or about 1.0 wt % to about 7.0 wt % of $C_9$+ non-normal olefins. Alternatively, the final boiling point temperature of the olefinic recycle stream should be no greater than about 295° F. (146° C.), no greater than about 275° F. (135° C.), such as no greater than about 265° F. (129° C.), or for example no greater than about 260° F. (127° C.). The final boiling point temperature of the olefinic recycle stream should be in the range of from about 260° F. (127° C.) to about 295° F. (146° C.), or from about 265° F. (129° C.) to about 275° F. (135° C.) Additionally, the initial boiling point temperature of the olefinic recycle stream should be at least about 215° F. (102° C.), such as at least about 235° F. (113° C.), for example, at least about 255° F. (124° C.), for example, at least about 275° F. (135° C.), or for example, at least about 295° F. (146° C.). The initial boiling point temperature of the olefinic recycle stream should be in the range of from about 215° F. (102° C.) to about 295° F. (146° C.), from about 235° F. (113° C.) to about 275° F. (135° C.), or from about 240° F. (116° C.) to about 255° F. (124° C.).

In one embodiment, the olefinic recycle stream contains no greater than about 60 wt %, or no greater than about 50 wt %, including no greater than about 40 wt %, or no greater than about 30.0 wt %, such as no greater than about 25.0 wt %, for example, no greater than about 20.0 wt %, or no greater than about 15.0 wt %, or no greater than about 10.0 wt % of $C_8$+ non-normal olefins. The olefinic recycle stream may contain from about 5.0 wt % to about 30.0 wt %, or from about 10 wt % to about 25 wt %, or from about 15 wt % to about 20 wt % of $C_8$+ non-normal olefins. Alternatively, the final boiling point temperature of the olefinic recycle stream should be no greater than about 245° F. (118° C.), such as no greater than about 230° F. (110° C.), or for example, no greater than about 215° F. (102° C.). The initial boiling point temperature of the olefinic recycle stream should be in the range of from about 215° F. (102° C.) to about 245° F. (118° C.), or from about 220° F. (104° C.) to about 230° F. (110° C.).

The amount of olefinic recycle stream fed to the oligomerization process is such that said olefinic recycle stream to fresh feed stream weight ratio is from about 0.1 to about 3.0, alternatively from about 0.5 to about 2.0, alternatively from about 0.5 to about 1.3. More particularly, the weight ratio of olefinic recycle stream to fresh olefinic feedstock can be at least 0.1, or at least 0.3, or at least 0.5, or at least 0.7 or at least 0.9, but generally is no greater than 3.0, or no greater than 2.5, or no greater than 2.0, or no greater than 1.8, or no greater than 1.5 or no greater than 1.3. The weight ratio of olefinic recycle stream to fresh olefinic feedstock can be from about 0.1 to about 3.0, or from about 0.3 to about 2.5, or from about 0.5 to about 2.0, or from about 0.7 to about 1.8, or from about 0.9 to about 1.5, or from about 1.0 to about 1.3.

The feed stream containing at least one $C_3$ to $C_8$ olefin derived from the conversion of an oxygenate has a particular advantage in the present invention in that it can provide an olefinic feed with substantially no sulfur as can be detected by any reasonable analysis. This lack of sulfur improves the efficacy of the subsequent hydrogenation step, particularly on noble metal catalysts, such as, but not limited to, palladium and platinum, to provide a fluid product with substantially no aromatics.

Oligomerization Process

The oligomerization process of the invention comprises contacting the $C_3$ to $C_8$ olefin feed and the olefinic recycle stream with a molecular sieve catalyst under conditions such that the olefins are oligomerized to produce a hydrocarbon composition conveniently comprising at least 90 wt % of $C_9$ to $C_{20}$ non-normal olefin, non-normal saturates or combinations thereof. Typically the hydrocarbon composition comprises less than 15 wt % of $C_{17}$+ non-normal olefins, and generally less than 15 wt % of $C_{17}$+ hydrocarbons.

The catalyst used in the oligomerization process can include any crystalline molecular sieve which is active in olefin oligomerization reactions. In one embodiment, the catalyst includes a medium pore size molecular sieve having a Constraint Index of about 1 to about 12. Constraint Index and a method of its determination are described in U.S. Pat. No. 4,016,218, which is incorporated herein by reference. Examples of suitable medium pore size molecular sieves are those having 10-membered ring pore openings and include those of the TON framework type (for example, ZSM-22, ISI-1, Theta-1, Nu-10, and KZ-2), those of the MTT framework type (for example, ZSM-23 and KZ-1), of the MFI structure type (for example, ZSM-5), of the MFS framework type (for example, ZSM-57), of the MEL framework type (for example, ZSM-11), of the MTW framework type (for example, ZSM-12), of the EUO framework type (for example, EU-1) and members of the ferrierite family (for example, ZSM-35).

Other examples of suitable molecular sieves include those having 12-membered pore openings, such as ZSM-18, zeolite beta, faujasites, zeolite L, mordenites, as well as members of the MCM-22 family of molecular sieves (including, for example, MCM-22, PSH-3, SSZ-25, ERB-1, ITQ-1, ITQ-2, MCM-36, MCM-49 and MCM-56). Other 10- and 12-member pore ring structure aluminosilicates and their SAPO analogs will also function.

Conveniently, the molecular sieve catalyst has a Constraint Index of about 1 to about 12, such as ZSM-5, ZSM-11, ZSM-12, ZSM-22, ZSM-57 and MCM-22, preferably ZSM-5. Conveniently, the crystalline molecular sieve catalyst has an average crystal size no greater than 0.15, or 0.12, or 0.10, or 0.07 or 0.05 micron and an alpha value between about 100 and about 600, or between about 200 and about 400, or between about 250 and about 350.

In one preferred embodiment, the molecular sieve catalyst comprises ZSM-5 having a homogeneous crystal size of <0.05 micron and a relatively high activity (alumina content) characterized by a $SiO_2/Al_2O_3$ molar ratio of around 50:1.

The molecular sieve may be supported or unsupported, for example, in powder form, or used as an extrudate with an appropriate binder. Where a binder is employed, the binder is conveniently a metal oxide, such as alumina, and is present in an amount such that the oligomerization catalyst contains between about 2 and about 80 wt % of the molecular sieve.

The oligomerization reaction should be conducted at sufficiently high WHSV of fresh feed to the reactor to ensure the desired level of $C_{17}$+ oligomers in the reaction product. In general, the reaction should occur at a WHSV of no less than 0.5, or no less than 0.7, or no less than 1.0, or no less than 1.2, or no less than 1.5, or no less than 1.7, or no less than 2.0, or no less than 2.2, or no less than 2.5, or no less than 2.8, or no less than 3.0, or no less than 3.5, or no less than 4.0, or no less than 4.5, or no less than 5.0, or no less than 5.5, or no less than 6.0 based on olefin in the fresh feed to the reactor and the amount of molecular sieve in the oligomerization catalyst. With regard to the combined fresh olefin feed and recycle to the reactor, the WHSV should be no less than about 0.7, or no less than about 1.0, or no less than about 1.2, or no less than about 1.5, or no less than about 1.7, or no less than about 2.0, or no less than about 2.2, or no less than about 2.5, or no less than about 3.0, or no less than 4.0, or no less than about 5.0, or no less than 6.0, or no less than about 7.0, or no less than 8.0 again based on the amount of molecular sieve in the oligomerization catalyst.

The upper level of WRSV is not narrowly defined but is generally no more than about 9.0, or no more than about 8.0 or no more than about 7.0 based on olefin in the fresh feed to the reactor and the amount of molecular sieve in the oligomerization catalyst. Increasing the WHSV beyond these levels may significantly decrease the catalyst/reactor cycle length between regenerations, especially at higher levels of $C_4$ conversion. For the same reason, the WHSV for the combined fresh olefin feed and recycle to the reactor should be no more than about 14, or no more than about 12 or no more than about 11 based on the amount of molecular sieve in the oligomerization catalyst.

In other embodiments of the process of the present invention, the contacting (a) is conducted at a WHSV of from about 0.5 to about 9.0, or from about 0.7 to about 9.0, or from about 1.0 to about 9.0, or from about 1.5 to about 9.0, or from about 1.7 to about 9.0, or from about 2.0 to about 9.0, or from about 0.5 to about 8.0, or from about 1.0 to about 8.0, or from about 1.5 to about 8.0, or from about 2.0 to about 8.0, or from about 0.7 to about 7.0, or from about 1.0 to about 6.0, or from about 1.5 to about 6.0, or from about 1.0 to about 5.0, or from about 1.5 to about 5.0 based on the olefin in the feed, and/or a WHSV of from about 0.5 to about 14, or from about 1.0 to about 14, or from about 1.2 to about 14, or from about 1.5 to about 14, or from about 1.7 to about 14, or from about 2.0 to about 14, or from about 2.2 to about 14, or from about 0.7 to about 12, or from about 1.0 to about 12, or from about 2.0 to about 12, or from about 2.5 to about 12, or from about 2.5 to about 9.0 based on the olefin in the combined feed and olefinic recycle stream.

The oligomerization process can be conducted over a wide range of temperatures, although generally the highest and lowest temperatures within the oligomerization reaction zone should be between about 150° C. and about 350° C., such as between about 180° C. and about 330° C., for example, between about 210° C. and about 310° C.

It is, however, important to ensure that the temperature across the reaction zone is maintained relatively constant so as to produce the desired level of $C_4$ olefin conversion at a given WHSV and point in the reaction cycle, and to minimize the production (yield) of undesirable butane and lighter saturates from the oligomerization reaction (contacting). Thus, as discussed above, the difference between the highest and lowest temperatures within the reactor should be maintained at about 40° F. (22° C.) or less, such as about 30° F. (17° C.) or less, for example, about 20° F. (11° C.) or less, conveniently about 10° F. (6° C.) or less, or even about 5° F. (3° C.) or less. The difference between the highest and lowest temperatures within the reactor should be maintained from about 1° F. (0.6° C.) to about 40° F. (22° C.), or from about 5° F. (3° C.) to about 30° F. (17° C.), or from about 10° F. (6° C.) to about 20° F. (11° C.).

The oligomerization process can be conducted over a wide range of olefin partial pressures, although higher olefin partial pressures are preferred since low pressures tend to promote cyclization and cracking reactions, and are thermodynamically less favorable to the preferred oligomerization reaction. Typical olefin partial pressures of olefins in the combined feed stream and olefinic recycle stream as total charge to the reactor comprise at least about 400 psig (2860 kPa), such as at least about 500 psig (3550 kPa), for example, at least about 600 psig (4240 kPa), or at least about 700 psig (4930 kPa), or at least about 800 psig (5620 kPa), or even at least about 900 psig (6310 kPa). Typical olefin partial pressures of olefins in the combined feed stream and olefinic recycle stream as total charge to the reactor are in the range of from about 400 psig (2860 kPa) to about 2000 psig (13,782 kPa), or from about 500 psig (3550 kpa) to about 1500 psig (10,337 kPa), or from about 600 psig (4240 kPa) to about 1200 psig (8269 kPa). It will, of course, be appreciated that the olefin partial pressure will be lower at the exit to the reactor as fewer moles of olefins exist due to the oligomerization reaction.

Typically, the conditions of the oligomerization process are controlled so as ensure that the conversion of $C_4$ olefins in the feed stream is at least about 80 wt %, or at least about 85 wt %, or at least about 90 wt %, or at least about 92 wt %, but no greater than about 99 wt %, or no greater than about 98 wt %, or no greater than about 96 wt %, or no greater than about 94 wt %. The conditions of the oligomerization process are controlled so as to ensure that the conversion of $C_4$ olefins in the feed stream is in the range of from about 80 wt % to about 99 wt %, or from about 85 wt % to about 98 wt %, or from about 90 wt % to about 96 wt %, or from about 92 wt % to about 94 wt %.

During the course of the oligomerization process, the catalyst will lose activity due to the accumulation of carbonaceous deposits and hence the $C_4$ olefin conversion will tend to decline with time. Thus to sustain a given level of $C_4$ olefin conversion, the temperature at which the oligomerization reaction is conducted is continually raised until some limit, discussed above, is reached. At that point, the catalyst is generally regenerated, either in situ or ex situ, by combustion of the coke deposits with oxygen/air using methods and conditions that are well known in the art. The regenerated catalyst may then be used again in the oligomerization reaction at some initial temperature, with the continually increasing temperature cycle being repeated.

The catalyst and the reactor conditions may be selected to achieve a low yield of butane and lighter saturates from the oligomerization reaction, such as no greater than about 2.0 wt %, or no greater than about 1.5 wt %, or no greater than about 1.0 wt % butanes and lighter saturates. The catalyst and the reactor conditions may be selected to achieve a low yield of butane and lighter saturates from the oligomerization reaction in the range of from about 0.1 wt % to about 2.0 wt %, or from about 0.2 wt % to about 1.5 wt % butanes and lighter saturates.

Conveniently, the oligomerization process is conducted in a plurality of serial adiabatic reactors with interstage cooling, such as is disclosed in U.S. Pat. No. 4,560,536, the entire contents of which is incorporated herein by reference. In order to achieve the desired low $\Delta T$ within each reactor, more than 3 reactors, for example, about 4 to 10 reactors, may be required. Conveniently, the reactors employed are boiling water reactors, sometimes called heat exchanger reactors, e.g., such as is discussed in U.S. Pat. Nos. 4,263,141 and 4,369,255 (for methanol production), and "Petroleum Processing, Principles and Applications," R. J. Hengstebeck, McGraw-Hill, 1959, pages 208-218 (specifically for olefin oligomerization, using solid phosphoric acid). Typically, the oligomerization is conducted to achieve a desired level of feed olefin conversion (such as $C_4$ olefin, noted above) in a single boiling water reactor, although a plurality of boiling water reactors may be used in parallel to provide additional capacity, and using boiling water reactors in series to achieve incremental olefin conversion of the effluent of one boiling water reactor by feeding it to another may also be employed.

Hydrocarbon Product Stream

The hydrocarbon composition recovered as the hydrocarbon product stream in the process of the invention comprises at least about 1.0 wt %, such as at least about 2.0 wt %, such as at least about 3.0 wt %, for example, at least about 4.0 wt %, conveniently at least about 5.0 wt %, or even at least about 10.0 wt % of $C_9$ non-normal olefin. Further, the hydrocarbon product stream comprises no greater than about 30 wt %, for example, no greater than about 25 wt %, conveniently no greater than about 20 wt %, or no greater than about 15 wt % of $C_9$ non-normal olefin. The hydrocarbon composition recovered as the hydrocarbon product stream in the process of the invention comprises in the range of from about 1.0 wt % to about 30 wt %, or from about 2.0 wt % to about 25 wt %, or from about 3.0 wt % to about 20 wt % of $C_9$ non-normal olefin.

In general, the hydrocarbon product stream contains at least about 90 wt %, for example, at least about 92 wt %, such as at least about 95 wt %, or even at least about 97 wt %, including at least about 99 wt % or at least about 99.5 wt % non-normal olefins, non-normal saturates or combinations thereof. The hydrocarbon product stream contains in the range of from about 90 wt % to about 97 wt %, or from about 92 wt % to about 95 wt % of $C_9$ to $C_{20}$ non-normal olefins, non-normal saturates or combinations thereof. Moreover, the hydrocarbon product stream generally contains at least about 0.5 wt %, or at least about 1.0 wt %, or at least about 2.0 wt %, or even at least about 3.0 wt %, or at least about 5.0 wt % of $C_{17}$ to $C_{20}$ non-normal olefins, but typically no greater than about 20 wt %, or no greater than about 15 wt %, or no greater than about 12.0 wt %, or no greater than about 10.0 wt %, or no greater than about 8.0 wt %, or no greater than about 6.0 wt %, or even no greater than about 4.0 wt %, or even no greater than about 2.0 wt % of $C_{17}$ to $C_{20}$ non-normal olefins. The hydrocarbon product stream generally contains in the range of from about 0.5 wt % to about 20 wt %, or from about 0.5 wt % to about 15 wt %, or from about 0.5 wt % to about 12 wt %, or from about 1.0 wt % to about 10 wt %, or from about 2.0 wt % to about 8.0 wt %, or from about 3.0 wt % to about 6.0 wt %, or from about 4.0 wt % to about 5.0 wt % of $C_{17}$ to $C_{20}$ non-normal olefins. $C_{21}$+ hydrocarbons, such as non-normal olefins, may also be present, though typically the content is low.

The initial boiling point of the hydrocarbon product stream is typically at least about 260° F. (127° C.), such as at least about 280° F. (138° C.), including at least about 300° F. (149° C.), for example, at least about 320° F. (160° C.), or even at least about 340° F. (171° C.), or even at least about 360° F. (182° C.). The initial boiling point of the hydrocarbon product stream is typically in the range of from about 260° F. (127° C.) to about 360° F. (182° C.), or from about 280° F. (138° C.) to about 340° F. (171° C.), or from about 300° F. (149° C.) to about 320° F. (160° C.) The final boiling point of the hydrocarbon product stream is typically no greater than about 350° C., such as no greater than about 330° C., for example, no greater than about 310° C. or even no greater than about 300° C. The final boiling point of the hydrocarbon product stream is typically in the range of from about 260° C. to about 350° C., or from about 280° C. to about 330° C.

In one embodiment, the hydrocarbon composition recovered as the hydrocarbon product stream in the process of the invention comprises at least about 3.0 wt %, for example, at least about 4.0 wt %, conveniently at least about 5.0 wt %, or even at least about 10.0 wt % of $C_8$ non-normal olefin. The hydrocarbon composition recovered as the hydrocarbon product stream in the process of the invention comprises in the range of from about 3.0 wt % to about 10.0 wt %, or from about 4.0 wt % to about 5.0 wt % of $C_8$ non-normal olefin. Further, the hydrocarbon product stream comprises no greater than about 25 wt %, conveniently no greater than about 20 wt %, or no greater than about 15 wt % of $C_8$ non-normal olefin. The hydrocarbon composition recovered as the hydrocarbon product stream in the process of the invention comprises in the range of from about 3.0 wt % to about 25 wt %, or from about 4.0 wt % to about 20.0 wt %, or from about 5.0 wt % to about 15.0 wt % of $C_8$ non-normal olefin.

In general, the hydrocarbon product stream contains at least about 60 wt % to no greater than about 90 wt % of $C_{11}$ to $C_{18}$ non-normal olefins, non-normal saturates or combinations thereof. Moreover, the hydrocarbon product stream generally contains at least about 50 wt % to no greater than about 75 wt % of $C_{12}$ to $C_{16}$ non-normal olefins, non-normal saturates or combinations thereof.

Additionally, the initial boiling point of the hydrocarbon product stream can be at least about 215° F. (102° C.), such as at least about 235° F. (113° C.), including at least about 255° F. (124° C.), for example, at least about 275° F. (135° C.), or even at least about 295° F. (146° C.). The initial boiling point of the hydrocarbon product stream is typically in the range of from about 215° F. (102° C.) to about 295° F. (146° C.), or from about 235° F. (113° C.) to about 275° F. (135° C.), or from about 240° F. (116° C.) to about 255° F. (124° C.). The hydrocarbon product stream can contain at least about 40 wt %, for example at least about 50 wt %, such as at least about 60 wt %, or even at least about 70 wt % of material having a boiling range of from about 365° F. (185° C.) to about 495° F. (257° C.).

The hydrocarbon product stream may contain at least about 40 wt %, or at least about 50 wt %, or at least about 60 wt %, or even at least about 70 wt % of material having a boiling range of from about 365° F. to about 495° F. (185° C. to 257° C.).

Separation of the Hydrocarbon Product Stream or the Hydrogenated Hydrocarbon Product Stream In one aspect of the process of the present invention, the hydrocarbon product stream can be separated into at least one hydrocarbon fluid composition, and potentially two or more hydrocarbon fluid compositions, and at least one remainder separated hydrocarbon product stream. This hydrocarbon fluid composition(s) will have a difference in initial boiling point and final boiling point that is lower than the difference possessed by the hydrocarbon product stream. In addition, this hydrocarbon fluid composition(s) will exhibit an aerobic biodegradability of at least 40% after 28 days.

In practicing the process of the present invention according to the paragraph directly above, one will produce a hydrocarbon fluid composition that is highly isoolefinic. This may be desirable for certain uses of the hydrocarbon fluid composition such as drilling fluids/drilling muds. There is evidence that the presence of an olefin on a molecule (of otherwise aliphatic character, i.e., preferably not a diolefin or an aromatic) can enhance the biodegradability of the molecule, that is, increase the percent biodegradability over a given period of time.

In another aspect of the process of the present invention, the hydrocarbon product stream can be separated into at least two or three separated hydrocarbon product streams, for example, a first separated hydrocarbon product stream and a remainder separated hydrocarbon product stream. A separated hydrocarbon product stream may then be hydrogenated (as described below) to form a hydrocarbon fluid composition. Alternatively, the hydrocarbon product stream can be hydrogenated (as described below) to form a hydrogenated hydrocarbon product stream. The hydrogenated hydrocarbon product stream can be separated to produce at least one hydrocarbon fluid composition (and optionally more than one) and a hydrogenated separated remainder stream. Each separated stream and fluid composition will have different boiling ranges, and each will have a difference in initial boiling point and final boiling point that is lower than the difference possessed by the hydrocarbon product stream. In addition, the hydrocarbon fluid composition(s) so produced will exhibit an aerobic biodegradability of at least 40% after 28 days.

In practicing the process of the present invention according to the paragraph directly above, one will produce a hydrocarbon fluid composition that is less isoolefinic and more isoparaffinic. By varying the extent of hydrogenation, one can produce a hydrocarbon fluid composition that is very low in olefin and/or aromatic content, leading to hydrocarbon fluid compositions with physical and chemical properties particularly suited for end uses as solvents.

In certain embodiments of the process of the present invention, at least one separated hydrocarbon product stream or hydrocarbon fluid composition has a minimum initial boiling point to maximum final boiling point at or within a range of about 110° C. to about 350° C., or about 130° C. to about 350° C., or about 150° C. to about 350° C., or about 170° C. to about 350° C., or about 185° C. to about 350° C. or about 190° C. to about 350° C., or about 200° C. to about 350° C., or about 210° C. to about 350° C. In other embodiments, at least one separated hydrocarbon product stream or hydrocarbon fluid composition has a minimum initial boiling point to maximum final boiling point at or within a range of about 110° C. to about 340° C., or about 130° C. to about 340° C., or about 150° C. to about 340° C., or about 170° C. to about 340° C., or about 185° C. to about 340° C., or about 190° C. to about 340° C., or about 200° C. to about 340° C., or about 210° C. to about 340° C.

In various other embodiments of the process of the present invention, at least one separated hydrocarbon product stream or hydrocarbon fluid composition has a minimum initial boiling point to a maximum final boiling point at or within a range of about 235 to about 289° F. (113 to 143° C.), or about 311 to about 354° F. (155 to 179° C.), or about 340 to about 376° F. (171 to 191° C.), or about 349 to about 394° F. (176 to 201° C.), or about 352 to about 408° F. (178 to 209° C.), or about 365 to about 412° F. (185 to 211° C.), or about 410 to about 504° F. (210 to 262° C.), or about 420 to about 495° F. (216 to 257° C.), or about 455 to about 534° F. (235 to 279° C.) or about 505 to about 624° F. (263 to 329° C.). Alternatively, at least one separated hydrocarbon product stream or hydrocarbon fluid composition has a minimum initial boiling point to a maximum final boiling point at or within a range of about 239° F. to about 282° F. (115° C. to 139° C.), or about 325° F. to about 349° F. (163° C. to 176° C.), or about 354° F. to about 369° F. (179° C. to 187° C.), or about 358° F. to about 385° F. (181° C. to 196° C.), or about 361° F. to about 399° F. (183° C. to 204° C.), or about 372° F. to about 405° F. (189° C. to 207° C.), or about 432° F. to about 496° F. (222° C. to 258° C.), or about 433° F. to about 489° F. (223° C. to 254° C.), or about 460° F. to about 525° F. (238° C. to 274° C.), or about 523° F. to about 592° F. (273° C. to 311° C.).

Potentially, at least two streams or compositions (e.g., a minimum of two of both, or a combination of one each, a separated hydrocarbon product stream and a hydrocarbon fluid composition) have a minimum initial boiling point to a maximum final boiling point at or within a range of about 235 to about 289° F. (113 to 143° C.), or about 311 to about 354° F. (155 to 179° C.), or about 340 to about 376° F. (171 to 191° C.), or about 349 to about 394° F. (176 to 201° C.), or about 352 to about 408° F. (178 to 209° C.), or about 365 to about 412° F. (185 to 211° C.), or about 410 to about 504° F. (210 to 262° C.), or about 420 to about 495° F. (216 to 257° C.), or about 455 to about 534° F. (235 to 279° C.) or about 505 to about 624° F. (263 to 329° C.).

The preferred method of separation, regardless of the order of separation, is fractional distillation using fractionation columns. The fractionation columns may be ordered in any number of ways to produce any number of the desired boiling ranges, e.g., making lighter cuts first from each of the overheads of fractionation columns in series. Additionally, some cuts not within the prescribed boiling ranges may be made on some columns to allow making the desired cuts on another column using the material not within the prescribed boiling ranges for some other purpose, such as fuel gas, motor gasoline, jet or diesel fuel.

Hydrogenation of the Hydrocarbon Product Stream or the Separated Hydrocarbon Product Stream The hydrocarbon product stream or separated hydrocarbon product stream(s) produced by the process of the invention can be used directly as a blending stock to produce jet or diesel fuel. Alternatively, the stream(s) can be hydrogenated, e.g., according to the method of U.S. Pat. Nos. 4,211,640 and 6,548,721, the entire contents of which are incorporated herein by reference, to saturate at least part of the olefins therein and produce a saturated product, such as a hydrogenated hydrocarbon product stream or a hydrocarbon fluid composition. The hydrogenated hydrocarbon product stream or a hydrocarbon fluid composition may also be used directly as a blending stock to product jet or diesel fuel, or the hydrocarbon fluid composition may be used in consumer products, agricultural chemicals, etc.

In the process of the present invention, the hydrogenated hydrocarbon product stream or hydrocarbon fluid composition can contain at least about 10 wt %, or at least about 20 wt %, or at least about 30 wt %, or at least about 40 wt % or at least about 50 wt %, or at least about 60 wt %, or at least about 70 wt %, or at least about 80 wt %, or at least about 85 wt %, or at least about 90 wt %, or at least about 95 wt %, or at least about 99 wt %, or at least about 99.9 wt % aliphatic hydrocarbons. The hydrogenated hydrocarbon product stream or hydrocarbon fluid composition can contain in the range of from about 10 wt % to about 99.9 wt %, or from about 20 wt % to about 99 wt %, or from about 50 wt % to about 99 wt % aliphatic hydrocarbons. All other characteristics of the hydrogenated hydrocarbon product stream or hydrocarbon fluid composition in terms of carbon number distribution, non-normal proportions and boiling point ranges will remain largely unchanged from the hydrocarbon product stream or separated hydrocarbon product stream(s).

Methods employing a "massive nickel" catalyst, or a noble metal (typically platinum and/or palladium) catalyst, that do not require or employ pre- or continuous sulfiding, are also effective in hydrogenating the hydrocarbon product stream or separated hydrocarbon product stream(s) produced by the process of the invention. Typically, molecular hydrogen is co-fed along with the olefinic stream across the hydrogenation catalyst, at temperatures, pressures and WHSV adequate to provide the desired level of saturation of all olefinic and aromatic species. These methods and conditions are well within the knowledge of those skilled in the art.

Thus in the process of the present invention, by appropriate hydrogenation, the hydrogenated hydrocarbon product stream or hydrocarbon fluid composition produced by the process of the invention may have a Bromine Index of no greater than about 1000 mg Br/100 g sample, or no greater than about 700 mg Br/100 g sample, or no greater than about 500 mg Br/100 g sample, or no greater than about 200 mg Br/100 g sample, or no greater than about 100 mg Br/100 g sample, or no greater than about 50 mg Br/100 g sample, or no greater than about 10 mg Br/100 g sample, or no greater than 5 mg Br/100 g sample or no greater than 2 mg Br/100 g sample.

Further alternatively or in addition, by appropriate hydrogenation, the hydrogenated hydrocarbon product stream or hydrocarbon fluid composition produced by the process of the invention may have a passing result on one or more of the Hot Acid Test and the ASTM Test Method D565. Highly saturated hydrocarbon fluid compositions may be desirable to achieve certain hygienic requirements for applications such as consumer products, for example as may be used in food packaging and processes associated therewith.

It should be noted that in the process of the present invention, the generation of aromatics may be very low to non-existent (in the oligomerization reaction). Thus, in some cases, hydrogenation may not significantly reduce the level the aromatics in the hydrogenated hydrocarbon product stream or hydrocarbon fluid composition; in some cases it may. Regardless, the hydrogenated hydrocarbon product stream or hydrocarbon fluid composition may have no greater than about 1000 wppm, or no greater than about 500 wppm, or no greater than about 100 wppm, or no greater than about 50 wppm, or no greater than about 10 wppm, or no greater than about 5 wppm, or no greater than about 2 wppm, or no greater than about 1 wppm aromatics.

Referring now to FIG. 1, there is shown one embodiment of an oligomerization process for producing a hydrocarbon composition according to the invention. The process shown in FIG. 1 employs an oligomerization system 10, comprising heat exchanger reactor system 26, oligomerized product separation device 46, hydrogenation unit 52 and hydrogenated hydrocarbon product separation system 60, among other elements. A feedstock stream containing at least one $C_3$ to $C_8$ olefin is provided in line 12, and an olefinic recycle stream containing no greater than 10 wt % $C_{10}$ olefins is provided in line 14, such that the weight ratio of the flow of olefinic recycle in line 14 to the flow of feedstock in line 12 is at least 0.1 and no greater than 3.0. The combined materials are provided via line 16 to feed/effluent heat exchanger 18 to form a first heated combined reactor feed in line 20. The first heated combined reactor feed in line 20 is passed through a preheat exchanger 22 to form a second heated combined reactor feed in line 24. The unnumbered line through preheat exchanger 22 represents a heating medium, for example 900 psig steam, and the second heated combined reactor feed in line 24 should be at a greater temperature than the first heated combined reactor feed in line 20, but have a temperature no greater than the desired oligomerization reaction temperature in heat exchanger reactor 27.

The second heated combined reactor feed in line 24 is provided to heat exchanger reactor 27, where it flows through tubes 28, coming into contact with catalyst contained within tubes 28. The rate of the second heated combined reactor feed in line 24 and amount of catalyst within the tubes 28 of heat exchanger reactor 27 are such that a WHSV of at least 1.5 is achieved, based on the content of olefin in the second heated combined reactor feed in line 24.

The oligomerization reaction thus occurs within tubes 28, generating heat, and the heat passes through tubes 28 to be absorbed by boiling water flowing around the outside of the tubes in shell side 30. The boiling water in shell side 30 is a mixture of steam and liquid water that passes through line 38 to disengaging vessel 34. Make-up liquid boiler feed water is provided in line 32 to disengaging vessel 34, and the combined liquid make-up boiler feed water and liquid water formed in the disengaging vessel 34 from the mixture of steam and liquid water that came through line 38 exit the bottom of disengaging vessel 34 through line 36. The steam generated in the heat exchanger reactor 27 emanates from the top of disengaging vessel 34 through line 40, and may be used, for example, to provide heat in fractionation tower reboilers or to make electricity in turbogenerators. The liquid water in line 36 is then provided to the shell side of heat exchanger reactor 27 to become the boiling water in shell side 30.

The presence of a substantially pure component, such as water, in a boiling state on the shell side 30 provides an almost constant temperature within shell side 30 and can, given other appropriate design considerations of heat exchanger reactor 27, provide for a very close approach to isothermal conditions for the reaction occurring within the tubes 28. The difference between the highest and lowest temperature within any and between all tubes 28 in heat exchanger reactor 27 is no greater than 40° F. Further, this configuration of heat exchanger reactor system 26 allows for good control of the reaction temperature within tubes 28 through controlling the pressure within the disengaging vessel 34 (sometimes called a "steam drum"). The pressure in the steam drum 34 controls the temperature at which the water will boil in shell side 30, one of the key factors governing the rate of absorbtion of the heat of reaction within tubes 28. As the catalyst in tubes 28 deactivates with time on stream, a given level of conversion of olefins can be obtained by increasing the pressure in steam drum 34, thus increasing the boiling temperature of the fluid in shell side 30, and increasing the temperature of the oligomerization reaction within tubes 28. Of course, the temperature of the boiling fluid in shell side 30 must be kept lower than the desired oligomerization reaction temperature within tubes 28, conveniently at least 5° C. lower, such as at least 10° C. lower, including at least 15° C. lower and even at least 20° C. lower, but typically not exceeding 40° C. lower to reduce the risk of introducing too great a radial temperature gradient within tubes 28 and decreasing the isothermality of the oligomerization reaction within tubes 28.

One design consideration for approaching isothermal conditions in heat exchanger reactor 27 is a relatively small diameter of the tubes 28, for example, an outside diameter of less than about 3 inches, conveniently less than about 2 inches, such as less than about 1.5 inches, and an inside diameter commensurate with the desired pressure rating for the inside of the tubes 28. This provides a relatively small resistance to heat transfer relative to the heat generated per unit volume of reaction space within tubes 28. Another such design consideration is a relatively long length for tubes 28, such as greater than about 5 meters, including greater than about 7 meters, conveniently greater than about 9 meters, which reduces the heat release per unit volume of reaction within tubes 28 and also promotes isothermality.

The oligomerization reaction product exits heat exchanger reactor 27 through line 42, and is provided to feed/effluent exchanger 18. The cooled reaction product exits feed/effluent exchanger 18 through line 44, and is provided to oligomerized product separation device 46. Separation device 46 may include one or more well known elements, such as fractionation columns, membranes, and flash drums, among other elements, and serves to separate the various components in the cooled reaction product in line 44 into various streams having differing concentrations of components than the cooled reaction product in line 44, including an olefinic recycle stream containing no greater than 10 wt % $C_{10}$ olefins in line 14. Also produced in separation device 46 is a hydrocarbon product stream in line 48 that contains at least 1 and no greater than 30 wt % $C_9$ non-normal olefins, and further has a first difference in initial and final boiling point temperatures. Additionally, one or more purge streams may be produced by separation device 46 and exit via line 50. Such purge streams in line 50 conveniently include streams richer in saturated hydrocarbons than the feedstock stream in line 12, such as a $C_{4-}$ rich stream containing unreacted butylenes and relatively concentrated $C_{4-}$ aliphatics, or a portion of material of identical or similar composition to that of the olefinic recycle stream in line 14 and relatively concentrated in $C_{5+}$ aliphatics. Providing such purge streams is convenient to controlling the partial pressure of olefins provided for reaction in heat exchanger reactor 27.

The hydrocarbon product stream in line 48 is provided to hydrogenation unit 52, along with a hydrogen containing stream in line 54. Hydrogenation unit 52 may include a hydrogenation reactor, one or more flash drums, a hydrogenated product recirculation pump to maintain a relatively low temperature increase across the hydrogenation reactor, and a light byproduct stabilizer column, among other elements. The olefins in the hydrocarbon product stream are thoroughly hydrogenated, for example, using a catalyst comprising platinum and/or palladium on an alumina support in a hydrogenation reactor, to provide a hydrogenated hydrocarbon product stream in line 56 having a Bromine Index no greater than 1000 mg Br/100 g sample. A purge stream in line 58 may exit hydrogenation unit 52, for example comprising unreacted hydrogen and minor amounts of undesirable low molecular weight cracking byproducts generated by a light byproduct stabilizer column within hydrogenation unit 52.

The hydrogenated hydrocarbon product stream in line 56 is provided to hydrogenated hydrocarbon product separation system 60. In this example, hydrogenated hydrocarbon product separation system 60 comprises two fractionation columns, notably first fractionation column 62 and second fractionation column 68, and the hydrogenated hydrocarbon product stream in line 56 is provided to first fractionation column 62. In first fractionation column 62, the hydrogenated hydrocarbon product stream in line 56 is separated into a first hydrogenated remainder separated stream as an overhead product in line 64 having a minimum initial boiling point to maximum final boiling point range (boiling range) according to ASTM Test Method D86-05 at or within a range of, for example, 235 to 289° F. (113 to 143° C.), or 311 to 354° F. (155 to 179° C.). First fractionation column 62 also generates a second hydrogenated remainder separated stream as a bottoms product in line 66.

The second hydrogenated remainder separated stream in line 66 has an initial boiling point and final boiling point temperature that is higher than that of the first hydrocarbon fluid composition in line 64, and is provided to second fractionation column 68. In second fractionation column 68, the second hydrogenated remainder separated stream in line 66 is separated into a first hydrocarbon fluid composition as an overhead product in line 70 having a boiling range different from, and in this case greater than, that of the first hydrocarbon fluid composition in line 64, and that also has a second difference in initial and final boiling point temperature that is less than that of the first difference of hydrocarbon product stream in line 48. For example, the first hydrocarbon fluid composition in line 70 may have a boiling range at or within a range of, for example, 340 to 376° F. (171 to 191° C.), or 349 to 394° F. (176 to 201° C.), or 352 to 408° F. (178 to 209° C.), or 365 to 412° F. (185 to 211° C.), or 420 to 495° F. (216 to 257° C.) or 505 to 624° F. (263 to 329° C.). Also generated by second fractionation column 68 is a second hydrocarbon fluid composition as a bottoms product in line 72 that has an initial boiling point and final boiling point temperature that is higher than that of the second hydrocarbon fluid composition in line 70, and a has third difference in initial and final boiling point temperature that is less than that of the first difference of hydrocarbon product stream in line 48. The second hydrocarbon fluid composition in line 72 may have, for example, yet another hydrocarbon fluid composition within one of the prescribed boiling ranges. (In an alternative embodiment, the material in line 72 may be another hydrogenated separated remainder stream, e.g., a high molecular weight byproduct to be used as a fuel blending stock).

Influencing the Character of Hydrocarbon Fluid Compositions

The hydrocarbon fluid composition has a number of characteristics described herein, the nature of which may be influenced, for example, by aspects of the process for oliogmerizing olefins to higher molecular weight hydrocarbons also described herein. One potential aspect has already been noted in how one can vary the degree of hydrogenation to affect the proportion of olefinic and aliphatic molecules in the resulting hydrocarbon fluid composition, which may have an impact on the extent of biodegradability relative to air stability.

It may also be desirable to affect the degree of branching of the hydrocarbon fluid composition. Typically, molecules with lower degrees of branching will have higher biodegradability. However, higher linearity brings with it undesirable aspects of processability as discussed earlier. Further, the aspect of the current inventive fluid involving its relatively high branchiness (and thus low cetane number) in conjunction with its superior biodegradability is an unexpected result in the art of hydrocarbon fluids, again, particularly for higher molecular weights/boiling ranges.

In the oligomerization process described herein, this may be the result of selecting a certain catalyst system. For example, ZSM-22 or ZSM-23, possibly modified by collidine, is known to provide more mono-methyl oligomer products, as described in PCT Publication WO 03/082780. Results directly according to that publication would be unsatisfactory for hydrocarbon fluids described herein, as the degree of branching is very low, and further, those catalysts are known to provide high levels of naphthenes, particularly in the higher molecular weight ranges ($\sim C_{11}+$) which is not conducive to biodegradability. However, in the oligomerization process described herein, one may consider using mixed catalyst systems in the reactor(s), say, employing ZSM-22 or ZSM-23 for a relatively low portion of the conversion of olefins and recycle in the beginning to promote linearity, and ZSM-5 at the end for further conversion of the olefins and recycle. ZSM-5 on its own is known to produce oligomers of quite high branching but with almost exclusively methyl character, on the order of one methyl group per every 4 to 5 carbon atoms.

In addition, without being bound by any one particular theory, the degree of branching in the hydrocarbon fluid composition may be impacted by the selection of feedstock. Feedstock selection can also change the breadth of carbon number species in a given hydrocarbon fluid composition, which can influence processability. For example, a feed comprising a higher level of $C_5$-$C_8$ linear olefins may provide a hydrocarbon fluid of reduced branching due to a lower number of molecular joining required to meet a given product molecular weight, and a feed comprising a relatively balanced distribution of $C_4$-$C_6$ olefins will provide a broader distribution of oligomer product isomers.

Further, without being bound by any one particular theory, the degree of branching and other characteristics of the hydrocarbon fluid composition can be varied along with the reaction temperature of the oligomerization process. Higher temperatures may promote more linear oligomers and lower temperatures may be conducive to more highly branched oligomers. In addition, selecting a relatively low difference between the highest and lowest temperatures within the reactor such as about 30° F. (17° C.) or less, for example, about 20° F. (11° C.) or less, conveniently about 10° F. (6° C.) or less, or even about 5° F. (3° C.) or less, at any given nominal operating temperature in the reactor, may enhance the hydrocarbon fluid composition characteristics favorable to biodegradability by limiting hydrogen transfer and cyclization reactions, reducing diolefin (or higher unsaturate), aromatic and naphthene formation.

The characteristics of the hydrocarbon fluid composition may also be impacted by selection of the boiling range. For example, consider the spectrum of hydrocarbon fluid compositions having a minimum initial boiling point to a maximum final boiling point at or within a range of 340 to 376° F. (171 to 191° C.), or 349 to 394° F. (176 to 201° C.), or 352 to 408° F. (178 to 209° C.), or 365 to 412° F. (185 to 211° C.), or 420 to 495° F. (216 to 257° C.) or 505 to 624° F. (263 to 329° C.). Compositions having a higher boiling range may have lower volatilities and higher viscosities but have lower biodegradability, while compositions with a lower boiling range may have the converse. Hydrocarbon fluid compositions having a minimum initial boiling point to a maximum final boiling point at or within a range of about 349 to 394° F. (176 to 201° C.), or 352 to 408° F. (178 to 209° C.), or 365 to 412° F. (185 to 211° C.), or 420 to 495° F. (216 to 257° C.) may have a particularly suitable balance, for example, for use as a drilling fluid. Hydrocarbon fluid compositions having a minimum initial boiling point to a maximum final boiling point at or within a range of about 505 to 662° F. (263 to 350° C.) may be particularly suitable, for example, as a polymer plasticizer.

Hydrocarbon Fluid Compositions

The hydrocarbon fluid composition of the present invention, for example as prepared by the process described herein, may have a minimum initial boiling point to maximum final boiling point at or within a range of about 110° C. to about 350° C., or about 130° C. to about 350° C., or about 150° C. to about 350° C., or about 170° C. to about 350° C., or about 185° C. to about 350° C., or about 190° C. to about 350° C., or about 200° C. to about 350° C., or about 210° C. to about 350° C. In other embodiments, the hydrocarbon fluid composition has a minimum initial boiling point to maximum final boiling point at or within a range of about 110° C. to about 340° C., or about 130° C. to about 340° C., or about 150° C. to about 340° C., or about 170° C. to about 340° C., or about 185° C. to about 340° C., or about 190° C. to about 340° C., or about 200° C. to about 340° C., or about 210° C. to about 340° C. Alternatively, the hydrocarbon fluid composition may have a minimum initial boiling point to a maximum final boiling at or within a range of from about 110° C. to about 330° C., or about 150° C. to about 280° C., or about 170° C. to about 265° C., or about 175° C. to about 260° C., or about 180° C. to about 215° C.

The hydrocarbon fluid composition of the present invention may have minimum initial boiling point to maximum final boiling point ranges according to ASTM Test Method D86-05 (boiling range) at or within a range of about 235 to about 289° F. (113 to 143° C.), or about 311 to about 354° F. (155 to 179° C.), or about 340 to about 376° F. (171 to 191° C.), or about 349 to about 394° F. (176 to 201° C.), or about 352 to about 408° F. (178 to 209° C.), or about 365 to about 412° F. (185 to 211° C.), or about 410 to about 504° F. (210 to 262° C.), or about 420 to about 495° F. (216 to 257° C.), or about 455 to about 534° F. (235 to 279° C.) or about 505 to about 624° F. (263 to 329° C.).

The hydrocarbon fluid composition of the present invention may be further characterized by having a passing result according to ASTM Test Method D565 (Standard Test Method for Carbonizable Substances in White Mineral Oil), and a passing result for the Hot Acid Test according to BGVV-XXXVI (now BFR: German Federal Institute for Risk Assessment, for liquid paraffins used in the production of polymers, papers and defoamers that may come into contact with food).

The hydrocarbon fluid composition of the present invention may also be characterized by having at least three carbon numbers, for example at least four carbon numbers, for example at least five carbon numbers, for example at least six or more carbon numbers within any given boiling range. The hydrocarbon fluid composition may also be characterized by having from three to ten carbon numbers, for example from four to eight carbon numbers, or for example from five to six carbon numbers. In general, the higher boiling range of the composition, the more different carbon number molecules there are in the cut. This is typically measured with the Linear Paraffin GC method, discussed below.

The hydrocarbon fluid composition of the present invention may also be characterized by having at least about 95 wt %, or at least about 97 wt %, or at least about 99 wt %, or at least about 99.5 wt %, or even at least about 99.9 wt % non-normal hydrocarbons. The hydrocarbon fluid composition may also be characterized by having from about 95 wt % to about 99.9 wt % non-normal hydrocarbons, or from about 97 wt % to about 99.5 wt % non-normal hydrocarbons, or from about 98 wt % to about 99 wt % non-normal hydrocarbons. The ranges noted in this paragraph may be applied to hydrocarbons as olefins (e.g., at least about 95 wt % non-normal olefins), or as paraffins (e.g., at least about 95 wt % non-normal paraffins), or a mixture thereof (e.g., at least about 95 wt % non-normal olefins plus non-normal paraffins).

The hydrocarbon fluid composition of the present invention may also be characterized by having no greater than about 1000 wppm, no greater than about 500 wppm, no greater than about 100 wppm, no greater than about 50 wppm, no greater than about 10 wppm, no greater than about 1 wppm, no greater than about 0.5 wppm, or even no greater than about 0.1 wppm aromatics. The hydrocarbon fluid composition may also be characterized by having from about 0.1 to about 1000 wppm, or about 0.5 to about 500 wppm, or about 1 to about 100 wppm, or about 10 to about 50 wppm aromatics.

The hydrocarbon fluid composition of the present invention may also be characterized by having a Bromine Index no greater than about 1000 mg Br/100 g sample, no greater than about 700 mg Br/100 g sample, no greater than about 500 mg Br/100 g sample, no greater than about 200 mg Br/100 g sample, no greater than about 100 mg Br/100 g sample, no greater than about 50 mg Br/100 g sample, no greater than about 10 mg Br/100 g sample, no greater than about 7 mg Br/100 g sample, no greater than about 5 mg Br/100 g sample, or even no greater than about 2 mg Br/100 g sample. The hydrocarbon fluid composition may also be characterized by having a Bromine Index from about 2 mg Br/100 g sample to about 1000 mg Br/100 g sample, or about 5 mg Br/100 g sample to about 700 mg Br/100 g sample, or about 7 mg Br/100 g sample to about 500 mg Br/100 g sample, or about 10 mg Br/100 g sample to about 200 mg Br/100 g sample, or about 50 mg Br/100 g sample to about 100 mg Br/100 g sample. Below these levels, the Hot Acid Wash test is more useful to evaluate the presence of aromatics without requiring very sensitive analysis on very expensive and complicated instruments.

The hydrocarbon fluid composition of the present invention may also be characterized by having no greater than about 10 wt % naphthenes, such as no greater than about 7 wt % naphthenes, for example no greater than about 5 wt % naphthenes, for example no greater than about 4 wt % naphthenes, for example no greater than about 3 wt %, for example no greater than about 2 wt %, or for example no greater than about 1 wt %. The hydrocarbon fluid composition may also be characterized by having from about 1 wt % to about 10 wt % naphthenes, for example from about 2 wt % to about 7 wt % naphthenes, or for example from about 3 wt % to about 5 wt % naphthenes.

The hydrocarbon fluid composition of the present invention may also be characterized by having an aerobic biodegradability according to the OECD Method 301 F of at least about 45%, or of at least about 50%, or of at least about 55%, or of at least about 60% after 28 days. In another embodiment, the hydrocarbon fluid composition of the present invention may also be characterized by having an aerobic biodegradability according to the OECD Method 301 F of no greater than about 70%, or no greater than about 60%, or no greater than about 55% after 28 days. The hydrocarbon fluid composition may also be characterized by having an aerobic biodegradability according to the modified Sturm OECD Method 301B of from about 40% to about 70%, or from about 45% to about 60% after 28 days. The aerobic biodegradability according to the OECD Method 301 F may continue to increase after 28 days. This is a peculiar attribute relative to conventional materials. For example, the aerobic biodegradability at 35 days can be higher than that at 28 days, say at least about 2, about 3, or about 5% higher, and further can be at least about 45, or about 50, or about 55, or about 60% after 35 days Additionally, the hydrocarbon fluid composition of the present invention may also have an anaerobic biodegradability according to test method ECETOC 28 of at least about 30%, or about 40%, or about 50%. Additionally, the anaerobic biodegradability according to test method ECETOC 28 may be from about 30% to about 50%, or from about 35% to about 40%.

The hydrocarbon fluid composition of the present invention may also be characterized by having a cetane number no greater than about 58, or about 55, or about 52, or about 50, or about 48, or about 45. The cetane number may be from about 30 to about 60, or from about 35 to about 55. The hydrocarbon fluid composition may also be characterized by having a cetane index of no greater than about 65, or about 60, or about 58, or about 55. The cetane index may be from about 40 to about 65, or from about 45 to about 60.

The hydrocarbon fluid composition of the present invention may also be characterized by having a hydrocarbon fluid pour point of no greater than about −25° F., or about −30° F., or about −40° F., or about −50° F., or about −60° F. The hydrocarbon fluid pour point may be from about −25° F. to about −60° F., or from about −30° F. to about −50° F. The hydrocarbon fluid composition may also be characterized by having a hydrocarbon fluid pour point of no greater than about −120° F., or about −100° F., or about −80° F., or about −60° F. The hydrocarbon fluid pour point may be from about −60° F. to about −120° F., or from about −80° F. to about −100° F. The hydrocarbon fluid composition may also be characterized by having a hydrocarbon fluid freezing point of no greater than about −35° F., or about −45° F., or about −55° F., or about −65° F. The hydrocarbon fluid pour point may be from about −35° F. to about −65° F., or from about −45° F. to about −55° F. The hydrocarbon fluid composition may also be characterized by having a hydrocarbon fluid cloud point of no greater than about −25° F., or about −35° F., or about −45° F., or about −55° F., or about −65° F. The hydrocarbon fluid pour point may be from about −25° F. to about −65° F., or from about −35° F. to about −55° F.

The hydrocarbon fluid composition of the present invention may also be characterized by having a branching index of at least about 1.5, or about 1.7, or about 2.0, or about 2.2, or about 2.5, or about 3.0. The hydrocarbon fluid composition may also be characterized by having a branching index of no greater than about 6.0, or about 5.0, or about 4.5, or about 4.0, or about 3.5. The branching index may be from about 1.5 to about 6.0, or from about 1.7 to about 6.0, or from about 2.2 to about 6.0, or from about 2.5 to about 6.0, or from about 1.5 to about 5.0, or from about 1.7 to about 5.0, or from about 2.0 to about 5.0, or from about 2.2 to about 6.0, or from about 2.2 to about 5.0, or from about 2.5 to about 5.0, from about 2.5 to about 4.0.

The hydrocarbon fluid composition of the present invention, particularly if made with olefins derived from some form of oxygenate conversion (especially methanol to olefins), may have substantially no sulfur, meaning the amount of sulfur in the hydrocarbon fluid composition is below the detectable level by any reasonable type of test no matter how sophisticated, or certainly no greater than 10 wppb or even 1 wppb. The low sulfur content of the hydrocarbon product stream may result in improved efficiency of the hydrogenation step, particularly on noble metal catalysts (Pd, Pt), resulting in a hydrocarbon fluid composition with a very low Bromine Index or passing the Hot Acid Wash Test, and potentially with substantially no aromatics and with very low naphthenes.

Uses

The fluids of the present invention have a variety of uses in for example drilling fluids, industrial solvents, in printing inks, as metal working fluids, in coatings, in household product formulations, as extenders in silicone sealant compositions. Therefore, in a further embodiment, the fluids of the present invention are used as new and improved solvents.

The fluids of this invention are particularly usefull as drilling fluids. In one embodiment, the invention relates to a drilling fluid having the fluid of this invention as a continuous oil phase. In another embodiment, this invention relates to a rate of penetration enhancer comprising a continuous aqueous phase having the fluid of this invention dispersed therein.

Drilling fluids used for offshore or on-shore applications need to exhibit acceptable biodegradability, human, eco-toxicity, eco-accumulation and lack of visual sheen credentials for them to be considered as candidate fluids for the manufacturer of drilling fluids. In addition, fluids used in drilling need to possess acceptable physical attributes. These generally include viscosity's of less than 4.0 cSt at 40° C. and, for cold weather applications, pour points of −40° C. or lower. These properties have typically been only attainable through the use of expensive synthetic fluids such as hydrogenated polyalpha olefins, as well as unsaturated internal olefins and linear alpha-olefins and esters. These properties are provided by some fluids of the present invention, the products having a boiling range in the range 235° C. to 300° C. (ASTM D-86) being preferred.

Drilling fluids may be classified as either water-based or oil-based, depending upon whether the continuous phase of the fluid is mainly oil or mainly water. At the same time water-based fluids may contain oil and oil-based fluids may contain water.

Water-based fluids conventionally include a hydratable clay, suspended in water with the aid of suitable surfactants, emulsifiers and other additives including salts, pH control agents and weighing agents such as barite. Water constitutes the continuous phase of the formulated fluid and is usually present in an amount of at least 50% of the entire composition; minor amounts of oil are sometimes added to enhance lubricity.

We have found that the fluids of the present invention are particularly useful in oil-based fluids having a hydrocarbon fluid as the continuous phase. These fluids typically include other components such as clays to alter the viscosity, and emulsifiers, gallants, weighting agents and other additives. Water may be present in greater or lesser amounts but will usually not be greater than 50% of the entire composition; if more than about 10% water is present, the fluid is often referred to as an invert emulsion, i.e. a water-in-oil emulsion. In invert emulsion fluids, the amount of water is typically up to about 40 wt % based on the drilling fluid, with the oil and the additives making up the remainder of the fluid.

One advantage of the use of the fluids of the present invention is that they possess low levels of normal paraffins and exhibit good biodegradability and low toxicity. Further they have low pour points compared to other products made from vacuum gas oil feeds. Their viscosity does not increase rapidly with decreasing temperature and therefore they disperse more rapidly in the cold water conditions found in deep sea environments and northern climates. Therefore drilling fluids based on the present invention typically do not need to be stored in heated areas, even in cold weather climates.

The fluids of the present invention may also be used as metal working fluids together with traditional additives, such as extreme pressure agents, antioxidants, biocides and emulsifiers if the lubricants are to be used as aqueous emulsions. The use of the fluids of the present invention results in a reduction of undesirable odours, less solvent loss due to undesirable evaporation. The fluids may also be used in lubricants that are operational at lower temperatures. The products of this invention may be used for aluminium rolling.

The fluids of the present invention are also useful to dissolve or suspend resins. In accordance with one aspect of the present invention, there is provided a solvent-resin composition comprising a resin component dissolved or suspended in the fluid of the present invention. The fluid component is typically 5-95% by total volume of the composition.

In accordance with a more limited aspect of the invention, the fluid is present in the amount 40-95% by total volume of the composition. In accordance with a still more limited aspect of the invention, the fluid is present in the amount 30%-80% by total volume of the composition.

The fluids of the present invention may be used in place of solvents currently used for inks, coatings and the like.

The fluids of the present invention may be used to dissolve resins such as:

- acrylic-thermoplastic;
- acrylic-thermosetting;
- chlorinated rubber;
- epoxy (either one or two part);
- hydrocarbon (e.g., olefins, terpene resins, rosin esters, petroleum resins, coumarone-indene, styrene-butadiene, styrene, methyl-styrene, vinyl-toluene, polychloroprene, polyamide, polyvinyl chloride and isobutylene);
- phenolic;
- polyester and alkyd;
- polyurethane;
- silicone;
- urea; and
- vinyl polymers and polyvinyl acetate as used in vinyl coatings.

It is to be appreciated that this list does not include all resin types. Other resin types are intended to be encompassed by the scope of the present invention.

The type of specific applications for which the solvents and solvent-resin blends of the present invention may be used are coatings, cleaning compositions and inks.

For coatings the mixture preferably has a high resin content, i.e., a resin content of 20%-60% by volume. For inks, the mixture preferably contains a lower concentration of the resin, i.e., 5%-30% by volume. In yet another embodiment, various pigments or additives may be added.

The formulations can be used as cleaning compositions for the removal of hydrocarbons, for dry cleaning, for industrial cleaning or for ink removal, in particular in removing ink from printing machines. In the offset industry it is very important that ink can be removed quickly and thoroughly from the printing surface without harming the metal or rubber components of the apparatus. Further there is a tendency to require that the cleaning compositions are environmentally friendly in that they contain no or hardly any aromatic volatile organic compounds and/or halogen containing compounds.

The hydrocarbon fluid compositions of the present invention are also useful as solvents for household consumer formulations, in particular for insecticide formulations such as those used in electrical wick insecticide devices, or as combustion fuels for portable stoves, in cosmetic products or in agricultural compositions. Other consumer products in which the hydrocarbon fluid compositions of the present invention may be used in include, but are not limited to, a metal polish or cleaner, a hard surface cleaner, a household lubricant, an aerosol or spray lubricant, a furniture wax or polish, an automotive wax or polish, an automotive rubbing compound, a hand cleaner, a hair shine, a wood cleaner, an adhesive or graffiti remover, an electrical or contact cleaner, an aerosol or spray insecticide, a foot wear or leather care product, a bug or tar remover, an air freshener, an air disinfectant, a carburetor or fuel injector cleaner, a general purpose or engine degreaser, an insect repellent, a paint remover or stripper, a rubber or vinyl protectant, charcoal lighter fluid, pocket lighter fluid, a liquid candle, or a candle wax remover.

The hydrocarbon fluid composition may also be compounded with an erstwhile crystalline polyolefin, conveniently polypropylene, to impart flexibility characteristics to the polyolefin, with the compound then used in an article of manufacture, such as a disposable medical gown.

The hydrocarbon fluid composition may also be used as a fuel, such as a diesel fuel or jet fuel.

The hydrocarbon fluid composition may also be used in water treating chemicals.

The invention will now be more particularly described with reference to the following examples.

EXAMPLES

Example 1

Olefinic feedstock and recycle materials were prepared as shown in Table 1 and were oligomerized over a catalyst comprising 65 wt % of 0.02 to 0.05 micron crystals of ZSM-5 having a $SiO_2/Al_2O_3$ molar ratio of 50:1, and 35 wt % of an alumina binder. The catalyst was in the form of 1/16 inch extrudates and about 90 cc of catalyst was blended with about 202 cc of inert, silicon carbide beads to reduce the heat generation per unit volume of reaction and placed in the reaction bed of a tubular reactor equipped with a heat management system that allowed the oligomerization reaction to proceed under near isothermal conditions.

TABLE 1

| | Charge A | | Charge B | |
|---|---|---|---|---|
| | Feed | Recycle | Feed | Recycle |
| | Wt % | | | |
| | 49.52 | 50.48 | 41.84 | 58.16 |
| | Proportion | | | |
| Comp. Wt % | 1 | 1.02 | 1 | 1.39 |
| Ethane | 0.00 | 0.00 | 0.00 | 0.00 |
| Ethylene | 0.00 | 0.00 | 0.00 | 0.00 |
| Propane | 0.00 | 0.00 | 0.01 | 0.00 |
| Propene | 0.00 | 0.00 | 0.00 | 0.00 |
| iso-butane | 7.24 | 0.10 | 0.99 | 0.02 |
| n-butane | 0.08 | 0.00 | 11.61 | 0.03 |
| t-butene-2 | 0.00 | 0.10 | 27.17 | 0.03 |
| butene-1 | 72.28 | 0.00 | 16.31 | 0.00 |
| iso-butene | 2.88 | 0.00 | 2.65 | 0.01 |
| c-butene-2 | 0.01 | 0.00 | 20.14 | 0.00 |
| iso-pentane | 0.01 | 0.09 | 0.80 | 0.04 |
| n-pentane | 1.72 | 0.00 | 1.56 | 0.04 |
| 1,3-butadiene | 0.00 | 0.00 | 0.05 | 0.00 |
| $C_5$ olefins | 15.75 | 0.10 | 17.28 | 0.15 |
| $C_6$ sats | 0.00 | 0.00 | 0.17 | 0.00 |
| $C_6$ olefins | 0.02 | 0.54 | 1.24 | 1.27 |
| $C_7$ olefins | 0.00 | 1.30 | 0.00 | 3.20 |
| n-heptane | 0.00 | 8.13 | 0.00 | 10.65 |
| $C_8$ olefins | 0.00 | 73.71 | 0.00 | 55.56 |
| $C_9$ olefins | 0.00 | 15.14 | 0.00 | 27.68 |
| $C_{10}$ olefins | 0.00 | 0.79 | 0.00 | 1.31 |
| Total | 100.00 | 100.00 | 100.00 | 100.00 |

Over the course of this first experimental run, various charges were provided to the reactor to test performance under various conditions over an extended period of time. As the experimental run progressed, the catalyst activity declined, requiring an increase in reactor temperature later in the run to achieve a given conversion of feedstock olefins. In two particular experiments, the feedstock and recycle materials were blended in the proportions shown in Table 1, and the single blended stream ("Charge") was provided to the reactor at 1000 psig (6891 kPa) and other conditions shown in Table 2; wherein the WHSV was based on the olefin in the total charge (combined feed and recycle) and, in this example, the total catalyst composition (ZSM-5 and binder). Four thermocouples were available, positioned evenly through the reaction bed in the reactor, with one very near the first point where the charge and catalyst come into contact, and one very near the outlet of the reaction bed. The difference between the highest and lowest temperatures within the reactor was from 2 to 7° C. The reaction product (oligomerization effluent stream) was analyzed with a gas chromatograph, and the composition of the products is provided in Table 2. No products having a carbon number greater than 21 were detected.

TABLE 2

| | Experiment (ca. Days On Stream) | |
|---|---|---|
| | 23 | 59 |
| | Charge | |
| | A | B |
| | Reactor T (° C.) | |
| | 235 | 274 |
| | WHSV (1/hr) | |
| Product Comp. Wt % | 4.2 | 3.9 |
| Ethane | 0.00 | 0.00 |
| Ethylene | 0.00 | 0.00 |
| Propane | 0.01 | 0.01 |
| Propene | 0.06 | 0.05 |
| iso-butane | 3.56 | 0.46 |
| n-butane | 0.14 | 4.33 |
| t-butene-2 | 1.97 | 0.66 |
| butene-1 | 0.58 | 0.22 |
| iso-butene | 0.21 | 0.25 |
| c-butene-2 | 1.26 | 0.43 |
| iso-pentane | 0.10 | 0.41 |
| n-pentane | 0.06 | 0.58 |
| 1,3-butadiene | 0.00 | 0.00 |
| $C_5$ olef | 1.63 | 1.51 |
| $C_6$ sats | 0.06 | 0.11 |
| $C_6$ olefins | 0.93 | 1.00 |
| $C_7$ olefins | 1.61 | 2.34 |
| n-heptane | 4.62 | 6.63 |
| $C_8$ olefins | 40.21 | 29.76 |
| $C_9$ olefins | 15.78 | 18.99 |
| $C_{10}$ olefins | 2.81 | 3.95 |
| $C_{11}$ olefins | 2.52 | 3.16 |
| $C_{12}$ olefins | 12.42 | 12.12 |
| $C_{13}$-$C_{15}$ olefins | 4.29 | 6.49 |
| $C_{16}$ olefins | 4.38 | 4.91 |
| $C_{17}$-$C_{20}$ olefins | 0.81 | 1.62 |
| Total | 100.00 | 100.00 |

Example 2

The same apparatus and procedure as Example 1 was utilized for a second, extended experimental run with a fresh batch of catalyst and another set of charge compositions as shown in Table 3. The olefinic feedstocks shown in Table 3 were produced by reacting methanol over a SAPO-34 catalyst generally according to the method of U.S. Pat. No. 6,673,978, with separation of the methanol reaction products to provide a $C_4$+ olefin composition. Over 90 wt % of the olefins in each feed composition were normal in atomic configuration, and the feed composition further contained about 1000 wppm oxygenates, such as methanol and acetone (not shown in Table 3), and 1000 ppm dienes. Some minor adjustments of some components in the feed compositions were made by additions of reagent grade materials to test certain aspects of the operation.

The olefinic recycle compositions shown in Table 3 were produced by taking accumulated batches of the reaction products from the first and this second experimental run and periodically providing those batches to a fractionation tower to separate a distillate product from a light olefinic recycle material, collecting those fractionated materials, and using the fractionated light olefinic recycle material for subsequent experiments. Over 90 wt % of the olefins in each recycle composition were non-normal in atomic configuration. Some minor adjustments of some components in the recycle compositions were made via addition of reagent grade materials to account for unavoidable losses in the fractionation step and test certain other aspects of the operation.

TABLE 3

| | Charge C | | Charge D | | Charge E | | Charge F | |
|---|---|---|---|---|---|---|---|---|
| | Feed | Recycle | Feed | Recycle | Feed | Recycle | Feed | Recycle |
| Wt % | 38.31 | 61.69 | 45.45 | 54.55 | 49.72 | 50.28 | 47.62 | 52.38 |
| Proportion | 1 | 1.61 | 1 | 1.20 | 1 | 1.01 | 1 | 1.10 |
| Comp. Wt % | | | | | | | | |
| Butane | 2.02 | 16.62 | 2.29 | 9.99 | 2.80 | 9.28 | 2.13 | 7.53 |
| Butenes | 63.50 | 3.05 | 64.35 | 2.69 | 64.55 | 2.97 | 64.93 | 3.09 |
| Dienes | 0.10 | 0.00 | 0.09 | 0.00 | 0.08 | 0.00 | 0.06 | 0.00 |
| Pentane | 0.54 | 4.72 | 1.75 | 0.19 | 1.37 | 0.97 | 1.50 | 1.85 |
| Pentenes | 21.75 | 1.69 | 20.84 | 2.25 | 20.69 | 2.49 | 21.09 | 2.25 |
| Hexanes | 0.25 | 0.13 | 0.26 | 0.13 | 0.18 | 0.29 | 0.17 | 0.54 |
| Hexenes | 11.81 | 1.27 | 10.40 | 3.10 | 10.31 | 3.52 | 10.10 | 4.29 |
| Heptenes | 0.01 | 2.98 | 0.01 | 3.37 | 0.01 | 3.24 | 0.01 | 3.39 |
| n-Heptane | 0.00 | 6.63 | 0.00 | 7.46 | 0.00 | 7.64 | 0.00 | 8.05 |
| Octenes | 0.02 | 44.09 | 0.01 | 49.63 | 0.01 | 48.90 | 0.01 | 52.84 |
| Nonenes | 0.00 | 18.64 | 0.00 | 20.99 | 0.00 | 20.52 | 0.00 | 16.17 |
| Decenes | 0.00 | 0.18 | 0.00 | 0.20 | 0.00 | 0.19 | 0.00 | 0.00 |
| Total | 100.00 | 100.00 | 100.00 | 100.00 | 100.00 | 100.00 | 100.00 | 100.00 |

For a number of particular experiments using the charge material and proportions shown in Table 3, the butylene conversion and yield of $C_{10}$+ material in the reactor product for each of the charge compositions under a variety of temperature and approximate days on stream are provided in Table 4. In all of the experiments shown in Table 4, the total reactor pressure was about 1000 psig (7000 kPa), the WHSV was between 3.5 and 4.0 based on the olefin in the total charged (combined feed and recycle) and, in this example, the total catalyst composition (ZSM-5 and binder), and the difference between the highest and lowest temperature within the reactor was 10° C. or less.

TABLE 4

| Experiment (Days on Stream) | Charge | Reactor T (° C.) | $C_{4-}$ conversion (wt %) | $C_{10+}$ yield (wt %) |
|---|---|---|---|---|
| 2 | C | 207 | 93.3 | 38.0 |
| 3 | C | 212 | 97.9 | 43.4 |
| 5 | C | 211 | 91.9 | 36.0 |
| 8 | C | 211 | 87.9 | 32.1 |
| 13 | D | 221 | 98.4 | 46.3 |
| 14 | D | 220 | 96.3 | 41.6 |
| 15 | D | 220 | 95.5 | 40.2 |
| 17 | D | 220 | 92.4 | 37.1 |
| 20 | E | 225 | 95.6 | 40.1 |
| 24 | E | 227 | 94.6 | 38.3 |
| 32 | E | 233 | 95.1 | 37.4 |
| 41 | E | 244 | 96.2 | 37.6 |
| 46 | E | 247 | 96.2 | 37.5 |
| 51 | E | 253 | 97.2 | 38.7 |
| 55 | F | 252 | 94.9 | 33.0 |
| 57 | F | 255 | 96.0 | 33.5 |
| 59 | F | 259 | 97.0 | 37.0 |
| 62 | F | 259 | 96.8 | 36.0 |

Example 3

Several batches of distillate materials (hydrocarbon product streams) were produced from the fractionation of various batches of reactor product (oligomerization effluent stream) obtained in the first and second experimental runs. The carbon number distribution of those distillate material batches, via the Linear Paraffin GC method, are provided in Table 5.

Distillates 1 and 2 in Table 5 were obtained from fractionation operations using the aggregate reactor product from the first experimental run, while Distillate 3 was obtained from fractionation operations of the aggregate reactor product from Charges C, D, and E of the second experimental run. All of the distillate materials contain all of the $C_{11}$+ and almost all of the $C_{10}$ material present from the reaction products, i.e., no separation of any components heavier than $C_{11}$ was conducted on the reactor product in obtaining the distillate materials. As obtained directly from the reactor product via the fractionation tower, all the distillate materials are over 90 wt % non-normal olefin, and further contain very low amounts of aromatics (<100 wppm).

Example 4

The batches of distillate materials (hydrocarbon product streams) obtained in Example 3 were hydrogenated in discrete batches by reacting them with hydrogen over a hydrogenation catalyst (to form hydrogenated hydrocarbon product streams). Distillates 1 and 2 were hydrogenated over a nickel-containing catalyst while Distillate 3 was hydrogenated over a palladium-containing catalyst, each according to operations and conditions well known. The carbon number distribution of the distillates are provided in Table 5 and in Table 5A. Hydrogenation did not significantly change the non-normal character of distillate compositions although, following hydrogenation, the distillate materials were almost completely aliphatic. No products having a carbon number greater than 21 were detected. Table 5 provides the carbon number distribution according to the Linear Paraffin GC method, which defines carbon number as all peaks eluting between two adjacent linear paraffins.

In Table 5A the carbon distribution of the non-hydrogenated distillate samples is given using more detailed references for various carbon number isomers. Retention times of known normal and mono-methyl isomers are determined. The normal (or linear) paraffin is known to have the longest retention time. Every peak between the shortest retention time mono-methyl of $C_n$ and normal $C_n$ is assumed to be a branched species of $C_{n+1}$. Every peak between the normal $C_n$ and shortest retention time mono-methyl $C_{n+1}$ is assumed to be a relatively low branched $C_{n+1}$.

With the linear paraffin method what is defined as $C_n$ can contain, e.g., a $C_{n-1}$ or $C_{n+1}$ isomer due to overlapping GC peaks. As a result, there are differences between the carbon distribution in Table 5 and 5A for the same distillate samples.

The GC analysis data for both Table 5 and 5A were collected on a PONA (Paraffin, Olefin, Naphthene, Aromatic) Gas Chromatograph. On this GC, the distillate sample, prior to entering the GC separation column, is coinjected with hydrogen across a small reactor bed containing saturation catalyst. All the olefinic material in the distillate sample to the GC separation column is thus saturated (if not yet saturated before by hydrogenation). However, it is believed that the carbon number distribution (CND) measured herein are accurate.

TABLE 5

| | Distillate | | |
|---|---|---|---|
| | 1 | 2 | 3 |
| Comp (wt %) | Before and after hydrogenation | | |
| $C_4$-$C_7$ | 0.06 | 0.18 | 0.06 |
| $C_8$ | 0.05 | 0.57 | 0.10 |
| $C_9$ | 4.80 | 19.32 | 12.58 |
| $C_{10}$ | 8.66 | 9.24 | 12.59 |
| $C_{11}$ | 16.24 | 13.05 | 14.30 |
| $C_{12}$ | 31.99 | 26.71 | 22.84 |
| $C_{13}$ | 12.78 | 11.61 | 11.65 |
| $C_{14}$ | 5.72 | 4.96 | 6.92 |
| $C_{15}$ | 8.13 | 5.92 | 7.66 |
| $C_{16}$ | 5.78 | 4.47 | 5.29 |
| $C_{17}$ | 2.15 | 1.81 | 2.53 |
| $C_{18}$ | 1.46 | 1.03 | 1.73 |
| $C_{19}$ | 1.24 | 0.73 | 1.07 |
| $C_{20}$ | 0.96 | 0.39 | 0.70 |
| Total | 100.00 | 99.99 | 100.00 |
| % normal paraffins | 3.17 | 3.49 | 2.75 |

TABLE 5A

| | Distillate | | |
|---|---|---|---|
| | 1 | 2 | 3 |
| Comp (wt %) | Before hydrogenation | | |
| $C_4$-$C_7$ | 0.25 | 0.42 | 0.68 |
| $C_8$ | 0.35 | 0.95 | 1.03 |
| $C_9$ | 4.94 | 19.76 | 13.25 |
| $C_{10}$ | 8.69 | 9.35 | 12.95 |
| $C_{11}$ | 8.46 | 7.45 | 8.11 |
| $C_{12}$ | 39.13 | 32.44 | 29.17 |
| $C_{13}$-$C_{15}$ | 16.72 | 14.87 | 15.99 |
| $C_{16}$ | 15.85 | 11.16 | 13.80 |
| $C_{17}$-$C_{20}$ | 5.61 | 3.59 | 5.01 |
| Total | 100.0 | 100.0 | 100.0 |

Table 6 provides composition and other physical and fuel performance properties of the hydrogenated distillate materials.

TABLE 6

| | Distillate | | | |
|---|---|---|---|---|
| | 1 | 2 | 3 | |
| | After hydrogenation | | | |
| Distillation $T_{10}$ (° C.) | 188 | 165 | 171 | ASTM D86 |
| Distillation $T_{90}$ (° C.) | 265 | 250 | 269 | ASTM D86 |
| Distillation End Point (° C.) | 304 | 293 | 308 | ASTM D86 |
| Flash Point (° C.) | 57 | 42 | 47 | ASTM D94 |
| Density @ 15° C. (kg/l) | 0.767 | 0.756 | 0.765 | ISO 12185 |
| Viscosity @ 40° C. ($mm^2/s$) | 1.53 | 1.26 | 1.42 | ASTM D445 |
| Viscosity @ 20° C. ($mm^2/s$) | 2.16 | 1.72 | | ASTM D445 |
| Viscosity @ −20° C. ($mm^2/s$) | 6.06 | 4.15 | | ASTM D445 |
| Freeze Point (° C.) | −56 | −62 | <−50 | ASTM D2386 |
| Aromatics (wppm) | 25 | | 49 | Ultra-violet |
| Sulfur (wppm) | <0.1 | <0.1 | <0.1 | ASTM D2622 |
| Olefins (wt %) | <0.01 | <0.01 | <0.01 | ASTMD2710 |
| Appearance | Clear and Bright | | | visual |
| Acidity (mg KOH/g) | 0.02 | 0.01 | | ASTM D3232 |
| Heat of Combustion (MJ/kg) | 78.72 | 79.22 | | ASTM D3338 |
| Smoke Point (mm) | 45 | 41 | | ASTM D1322 |
| Copper Strip Corrosion | 1a | 1a | | ASTM D130 |
| JFTOT Breakpoint (° C.) | 295 | >315 | | ASTM D3241 |
| Existent Gum (mg/100 ml) | 2 | 1 | | ASTM D381 |
| Hydrogen Content (wt %) | 14.51 | 15.12 | | ASTM D3343 |
| Microseparator (rating) | 100 | 99 | | ASTM D3948 |
| Electrical Conductivity (pS/m) | 0 | 0 | | ASTM D2642 |
| Peroxides (mg/kg) | 0.9 | 0.6 | | ASTM D3703 |
| Cetane Number | 48.2 | 47.0 | | ASTM D613 |

Example 5

An inventive hydrocarbon fluid composition with volatility similar to commercial Isopar™ brand M Fluid marketed by ExxonMobil Chemical Company was prepared by first fractionating the hydrogenated Distillate 2 material of the previous example into multiple 2.5 vol % cuts and then recombining consecutive cuts 24 to 36 (57.5-90 vol % cuts). The boiling ranges of the new fluid and the sample of Isopar™ brand M Fluid were measured by GC simulated distillation (e.g., ASTM D2887). Results shown in Table 7 below indicate that the boiling ranges of the two fluids are similar.

TABLE 7

| Mass % | Inventive Fluid | Isopar ™ brand M Fluid |
|---|---|---|
| 0% (Initial boiling point) | 402° F. (205° C.) | 382° F. (194° C.) |
| 10% | 418° F. (214° C.) | 412° F. (211° C.) |
| 25% | 431° F. (222° C.) | 441° F. (227° C.) |
| 50% | 460° F. (238° C.) | 468° F. (242° C.) |
| 75% | 499° F. (259° C.) | 485° F. (252° C.) |
| 90% | 521° F. (272° C.) | 503° F. (262° C.) |
| 100% (Final boiling point) | 549° F. (287° C.) | 540° F. (282° C.) |

Example 6

Figure 2:
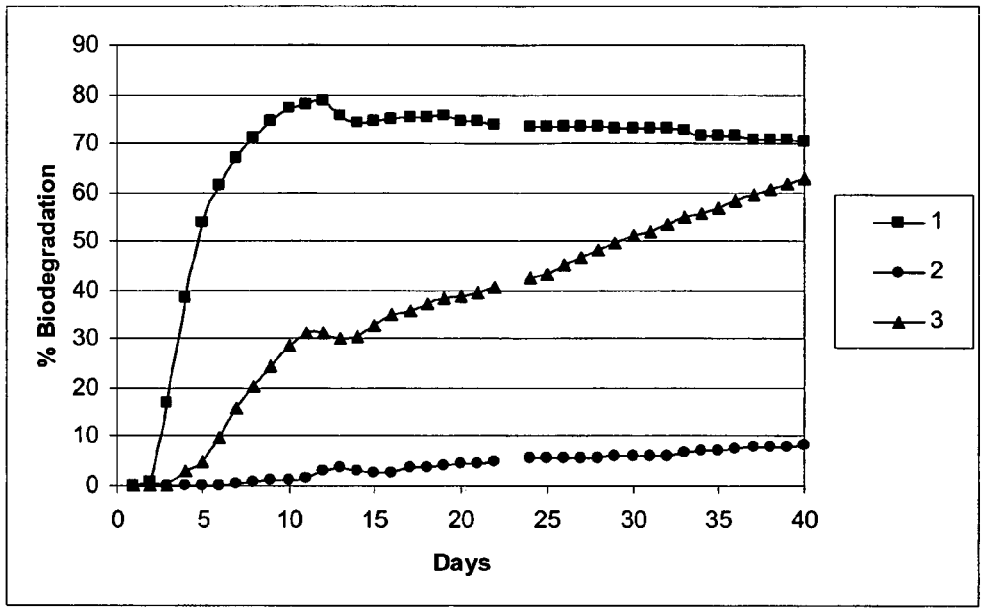
FIG. 2 is a graphical representation of biodegradability data of comparative examples and an isoparaffinic hydrocarbon material of the present invention.
Figure 3:
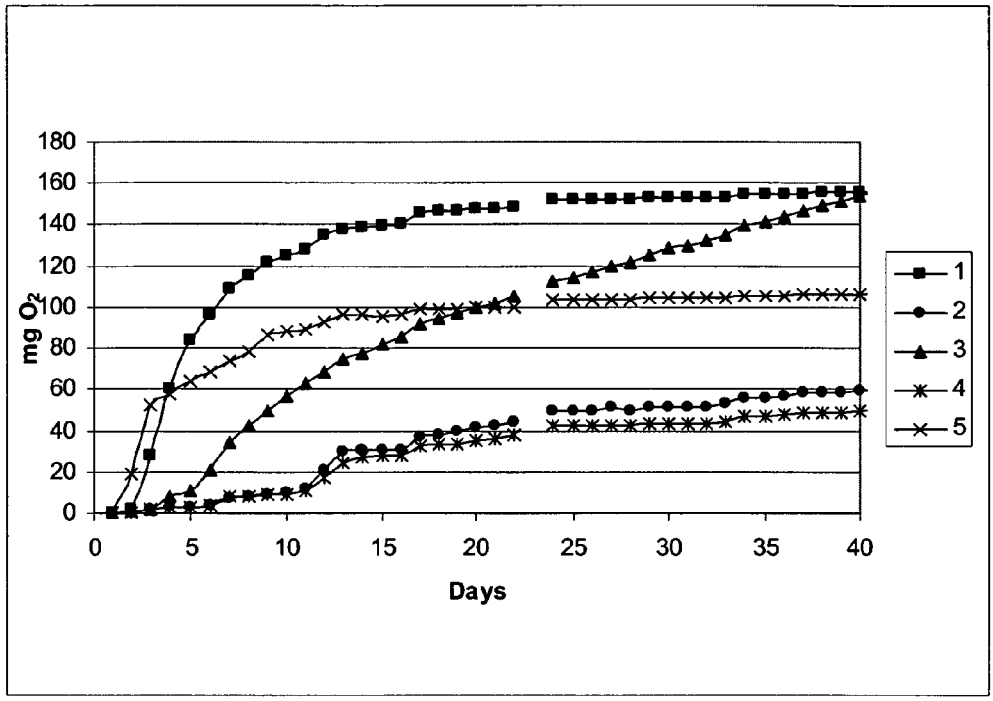
FIG. 3 is a graphical representation of oxygen uptake data of comparative examples and an isoparaffinic hydrocarbon material of the present invention.

A number of physical properties of the inventive hydrocarbon fluid composition from Example 5 were measured and compared with data available for commercial Isopar™ M and Norpar™ 13 fluids, obtained from ExxonMobil Chemical Company. The latter two fluids are conventional isoparaffin and normal paraffin products with volatility similar to that of the inventive fluid. Data are shown in Table 8 below. Detailed data on biodegradability of the Isopar™ brand M fluid and inventive hydrocarbon fluid composition with time from OECD Method 301 F are provided in FIG. 2, with accompanying data on oxygen uptake from the same biodegradability test provided in FIG. 3. Also included in the biodegradability test as shown in FIGS. 2 and 3 were several standard reference materials (e.g., canola oil and blank inoculum). Line 1 of FIGS. 2 and 3 is canola oil, line 2 of FIGS. 2 and 3 is Isopar™ brand M fluid, and line 3 of FIGS. 2 and 3 is the inventive hydrocarbon fluid composition. Line 4 of FIG. 3 is the blank inoculum and line 5 of FIG. 3 is sodium benzoate. No data was collected on day 22 because of a power failure/computer malfunction. FIG. 2 shows that the inventive hydrocarbon fluid composition has high biodegradability and that the biodegradability of the inventive hydrocarbon fluid composition increases over the 40 days of testing, which is peculiar to the inventive hydrocarbon fluid composition. FIG. 3 shows that there is an increase in oxygen uptake over the 40 day test, therefore coinciding with the increase in biodegradability of the inventive hydrocarbon fluid composition.

The data in Table 8 below show that the inventive hydrocarbon fluid composition has an outstanding combination of properties. Its volatility (boiling range, flash point), solvency (aniline point), purity (aromatics wt %), and viscosity are similar to those of the two commercial fluids. The inventive hydrocarbon fluid composition has better low temperature properties (lower pour point) and lower photochemical reactivity relative to the two commercial fluids and has biodegradability that is close to that needed for readily biodegradable status (60% in 28 days). The latter may be achievable for other inventive hydrocarbon fluid compositions made with adjustments of process conditions and/or catalyst within the scope of this invention. The data for Isopar™ brand M fluid show its inferior biodegradability when compared with the inventive hydrocarbon fluid composition. The data for Norpar™ brand 13 fluid show its inferior low temperature properties (relatively high pour point) when compared with the inventive hydrocarbon fluid composition.

TABLE 8

| Property/Units | Test Method | Inventive Fluid | Isopar ™ brand M Fluid | Norpar ™ brand 13 Fluid |
|---|---|---|---|---|
| Distillation Range (° C.) | ASTM D86-05 | 222-261 | 225-254 | 222-242 |
| Flash Point (° C.) | ASTM D93 A | 91 | 92 | 97 |
| Composition | | | | |
| Wt % paraffin | Mass spec | 96.5 | 82 | 100 |
| Wt % naphthene | Mass spec | 3.5 | 18 | 0 |
| Wt % aromatic | UV absorption | 0.02 | 0.01 | <0.01 |
| Photochemical reactivity [g ozone/g emitted] | Per bins in CARB Aerosol Coatings Regulation | 0.51 | 0.57 | 0.81* |
| Biodegradability (wt % in 28 days) | OECD 301 F | 50** | 8** | 83*** |
| Viscosity @ 40° C. [cS] | ASTM D445 | 2.1 | 2.6 | 1.8 |
| Aniline point (° C.) | ASTM D611 | 89 | 89 | 88 |
| Pour point (° C.) | ASTM D97 or D5950 | −95 | −57 | −4 |

*This value would be 0.51 if the distillation range were shifted slightly higher to raise the mean boiling point to 238 C.
**From side-by-side biodegradation test
***From separate biodegradation test Naphthenes Measurement Table 9 below provides detailed information regarding the low naphthene content and other pertinent properties of the hydrocarbon fluid compositions of the present invention. Also provided is similar information for conventional hydrocarbon fluids. Some of these conventional hydrocarbon fluids are formed via commercial and laboratory processes other than that disclosed herein, including oligomerization of propylene and butylenes over solid phosphoric acid (sPa), and molecular sieve catalysts ZSM-22 and ZSM-57, conducted without any recycle of olefinic material derived from the oligomerization effluent. All materials in Table 9 have been fully hydrogenated to contain similar, very low concentrations of anything but aliphatics.

In Table 9, reference materials with known properties were obtained from various sources, notably samples A, B, C, D, K, P and Q. Sample A is a very highly branched iso-dodecane product available from providers of reagent grade chemicals, for example, Bayer. Similarly, Sample C is a completely linear dodecane from, for example, Aldrich. Sample B is a 2/1 w/w mixture of those two materials (⅔ Sample A and ⅓ Sample C materials by weight), to approximate the very mixed branching nature of both the inventive and commercial materials while accounting for the relatively large impact of normal paraffins on refractive index. These aforementioned reference materials are known to contain almost no naphthenes. Sample Q is a commercial Nappar™ brand 10 product obtained from ExxonMobil Chemical Company, in this case produced by a facility in the U.S, known to be almost 100% naphthenes. Note the significant increase in both refractive index and density of the near 100% naphthenic material; the density is particularly significant given its considerably lower carbon number. Samples D, J and P are prepared mixtures of portions of Sample B and Sample Q in known concentrations, thus filling out the reference and calibration figures for subsequent determination of the remaining samples.

Regarding Table 9, Samples E, G, H and J are inventive compositions derived from distillations of the Distillates of Example 2 above. Samples F, I, L, M, N and O are compositions obtained from conventional sources, as noted, prepared by other oligomerization processes including distillation of the oligomerization effluent. All distillations were conducted to achieve roughly similar carbon number distributions in an instructive range around C12; the composition is detailed in Table 9. The initial boiling point of these non-reference compositions is about 335° F. (168° C.), and their final boiling point is about 410° F. (210° C.).

In Table 9, the content of naphthenes in the far right column is determined via a GC/MS method typically used in industry for these types of materials. It should be noted that this method is known to be increasingly less accurate with lower naphthene content, particularly at levels below about 5 wt %. This idiosyncrasy is shown most prominently in the results for Samples A and B, which by this GC/MS method show 5 wt % and 2 wt % naphthenes, respectively. However, it is known that these materials, by virtue of their method of manufacture as reagent grade chemicals and other analytical techniques, comprise virtually no naphthenes.

Table 9 also contains other properties of the various materials including refractive index and specific gravity. It is desirable to quantify the level of naphthenes in materials of this type via knowledge of and correlation with the properties of the various components because each species has distinct density and refractive index properties that may be interpolated to determine the blend quantities. The extremely low concentration of naphthenes of the inventive hydrocarbon fluid compositions correlate well with their corresponding very low refractive indices and specific gravities.

TABLE 9

| Sample | Source | Composition (carbon number, wt %) $C_9$ | $C_{10}$ | $C_{11}$ | $C_{12}$ | $C_{13}$ | Specific Gravity (15° C./15° C.) | Refractive Index (20° C./20° C.) | Naphthenes ASTM D2786 wt % |
|---|---|---|---|---|---|---|---|---|---|
| A Iso-$C_{12}$ | Reagent grade; e.g., Bayer | — | 0.1 | 0.3 | 99.2 | 0.3 | 0.7517 | 1.42098 | 5 |
| B Synthetic $C_{12}$ | 67/33 w/w mix iso-$C_{12}$/n-$C_{12}$ | 0.1 | 0.1 | 0.3 | 99.1 | 0.3 | 0.7518 | 1.42128 | 2 |
| C n-$C_{12}$ | Reagent grade; e.g., Aldrich | — | — | — | 100.0 | — | 0.7521 | 1.42210 | 0 |
| D Synthetic $C_{12}$, spiked | blended with 5.7 wt % Nappar ™ brand 10 | 0.6 | 3.6 | 0.9 | 94.1 | 0.7 | 0.7551 | 1.42280 | 6 |
| E Distillate 3 | Inventive, distillate 3 | — | 1.0 | 16.2 | 78.2 | 4.6 | 0.7599 | 1.42550 | 1 |
| F sPa $C_{3=}$ tetramer | ExxonMobil, France commercial | 0.2 | 6.0 | 25.6 | 62.3 | 5.1 | 0.7604 | 1.42460 | 2 |
| G Distillate 2 | Inventive, distillate 2 | — | 0.1 | 0.4 | 92.5 | 1.0 | 0.7606 | 1.42520 | 0 |
| H Distillate 2 | Inventive, distillate 2 | — | 0.5 | 6.6 | 64.1 | 25.3 | 0.7608 | 1.42500 | 0 |
| I sPa/ZSM-22 $C_{3=}$ tetra. | ExxonMobil, UK commercial | — | 0.9 | 33.8 | 64.1 | 1.0 | 0.7626 | 1.42543 | 8 |
| J Distillate 3 | Inventive, distillate 3 | — | 0.1 | 0.3 | 74.3 | 25.3 | 0.7629 | 1.42620 | 1 |
| K Synthetic $C_{12}$, spiked | blended with 20 wt % Nappar ™ brand 10 | 2.0 | 13.4 | 2.5 | 80.0 | 1.7 | 0.7635 | 1.42575 | 19 |
| L ZSM-22 $C_{3=}$ tetramer | ExxonMobil, UK commercial | 0.3 | 2.4 | 8.7 | 86.7 | 1.9 | 0.7636 | 1.42633 | 8 |
| M ZSM-57 $C_{4=}$ trimer | ExxonMobil, pilot plant | 0.1 | 0.3 | 5.5 | 91.3 | 2.7 | 0.7664 | 1.42755 | 8 |
| N Isopar ™ brand L | ExxonMobil, UK commercial | — | 0.1 | 15.7 | 71.2 | 9.2 | 0.7670 | 1.42763 | 12 |
| O ZSM-22 $C_{4=}$ trimer | ExxonMobil, Singapore comm. | 0.1 | 2.7 | 5.6 | 90.2 | 1.3 | 0.7729 | 1.42993 | 21 |
| P Synthetic $C_{12}$, spiked | blended with 40 wt % Nappar ™ brand 10 | 3.9 | 27.1 | 4.8 | 60.9 | 2.7 | 0.7755 | 1.43020 | 40 |
| Q Nappar ™ brand 10 | ExxonMobil, US commercial | 9.5 | 69.0 | 11.2 | 2.9 | 6.2 | 0.8132 | 1.44375 | 100 |

In addition to the testing for naphthenes discussed above, a sample of the broad boiling range Distillate 3 (hydrogenated) material, as described in Example 4, was run on a 2-D GC instrument. This was done, given the historical difficulty of measuring naphthenes, as another means to determine and validate the presence of naphthenes at any boiling range of hydrocarbon fluids of the present invention that may be derived from the process of the present invention. Using well understood naphthenes from a conventional diesel fuel as a marker to fingerprint the region where such naphthenes would be located, there was no indication that Distillate 3 contained any naphthenes at all.

The embodiment of a hydrocarbon of the present invention with a low concentration of naphthenes not only enhances biodegradability, but is also believed to enhance hygienic aspects, for example if used in consumer products, such as reduced skin irritation (relative to higher naphthene contents) for use as a base in an ointment or deodorant.

While the present invention has been described and illustrated by reference to particular embodiments, those of ordinary skill in the art will appreciate that the invention lends itself to variations not necessarily illustrated herein. The unique compositions may be anticipated to be generated in other fashions than the olefin oligomerization process described, and the novel olefin oligomerization process may employ numerous permutations, combinations and optimizations from the information provided. For this reason, then, reference should be made solely to the appended claims for purposes of determining the true scope of the present invention.

What is claimed is:

1. A process for producing a hydrocarbon fluid composition, the process consisting essentially of:

a. contacting a feed comprising at least one $C_3$ to $C_8$ olefin and an olefinic recycle stream with a molecular sieve catalyst in a reaction zone under olefin oligomerization conditions such that the recycle to feed weight ratio is from 0.1 to 3.0, the WHSV is at least 0.5 based on the olefin in the feed, and the difference between the highest and lowest temperatures within said reaction zone is 40° F. (22° C.) or less, said contacting producing a oligomerization effluent stream;

b. separating said oligomerization effluent stream into at least a hydrocarbon product stream having a first difference in initial boiling point and final boiling point temperatures, and said olefinic recycle stream, wherein the olefinic recycle stream contains no more than 10 wt % of $C_{10}$+ non-normal olefins, and the hydrocarbon product stream contains at least 1 wt % and no more than 30 wt % of $C_9$ non-normal olefins; and c. separating the hydrocarbon product stream into said hydrocarbon fluid composition and at least one remainder separated stream, wherein said hydrocarbon fluid composition has:

i. a second difference in initial boiling point and final boiling point temperatures, wherein said second difference is less than said first difference; and ii. an aerobic biodegradability of at least 40% at 28 days.

2. The process of claim 1 wherein said feed comprises a mixture of $C_3$ to $C_5$ olefins comprising at least 5 wt % of $C_4$ olefin.

3. The process of claim 1 wherein said feed contains $C_4$ olefin and the contacting (a) is conducted so as to convert from 85 wt % to 96 wt % of the $C_4$ olefin in the feed.

4. The process of claim 1 wherein the highest and lowest temperatures within said at least one reaction zone are between 150° C. and 350° C.

5. The process of claim 1 wherein the hydrocarbon product stream comprises from 0.5 wt % to 20.0 wt % of $C_{17}$ to $C_{20}$ hydrocarbons.

6. The process of claim 1 wherein said hydrocarbon product stream comprises at least 90 wt % $C_9$ to $C_{20}$ non-normal olefins.

7. The process of claim 1 wherein the hydrocarbon fluid composition comprises non-normal hydrocarbons of at least two different carbon numbers.

8. A process for producing a hydrocarbon fluid composition, the process consisting essentially of:

a. contacting a feed comprising at least one $C_3$ to $C_8$ olefin and an olefinic recycle stream with a molecular sieve catalyst in at least one reaction zone under olefin oligomerization conditions such that the recycle to feed weight ratio is from 0.1 to 3.0, the WHSV is at least 0.5 based on the olefin in the feed, and the difference between the highest and lowest temperatures within said reaction zone is 40° F. (22° C.) or less, said contacting producing a oligomerization effluent stream;

b. separating said oligomerization effluent stream into at least a hydrocarbon product stream having a first difference in initial boiling point and final boiling point temperatures, and said olefinic recycle stream, wherein the olefinic recycle stream contains no more than 10 wt % of $C_{10+}$ non-normal olefins, and the hydrocarbon product stream contains at least 1 wt % and no more than 30 wt % of $C_9$ non-normal olefins;

c. producing a hydrocarbon fluid composition from said hydrocarbon product stream by the steps of:

i. separating said hydrocarbon product stream to form at least a first separated hydrocarbon product stream and a remainder separated hydrocarbon product stream, and hydrogenating said first separated hydrocarbon product stream to form said hydrocarbon fluid composition; or ii. hydrogenating said hydrocarbon product stream to form a hydrogenated hydrocarbon product stream, and separating said hydrogenated hydrocarbon product stream to form said hydrocarbon fluid composition, wherein said hydrocarbon fluid composition has a second difference in initial boiling point and dry point temperatures, wherein said second difference is less than said first difference; and an aerobic biodegradability of at least 40% at 28 days.

9. The process of claim 8 wherein said hydrocarbon fluid composition has a Bromine Index of no greater than 1000 mg Br/100 g sample.

10. The process of claim 8 wherein said hydrocarbon fluid composition comprises at least 95 wt % non-normal paraffins.

11. The process of claim 8 wherein said hydrocarbon fluid composition comprises less than 10 wt % naphthenes.

* * * * *

UNITED STATES PATENT AND TRADEMARK OFFICE

CERTIFICATE OF CORRECTION

PATENT NO. : 7,667,086 B2
APPLICATION NO. : 11/342365
DATED : February 23, 2010
INVENTOR(S) : Kowalik et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1064 days.

Signed and Sealed this

Seventh Day of December, 2010

David J. Kappos

David J. Kappos
*Director of the United States Patent and Trademark Office*